US012781579B2

(12) United States Patent
Draeger et al.

(10) Patent No.: US 12,781,579 B2
(45) Date of Patent: Nov. 3, 2026

(54) PISTON-DIAPHRAGM PUMP FOR DRILLING OPERATIONS

(71) Applicant: Helmerich & Payne, Inc., Tulsa, OK (US)

(72) Inventors: Bart Draeger, Broken Arrow, OK (US); Rick E. Barrett, Owasso, OK (US); Robert Lee Stauder, Broken Arrow, OK (US)

(73) Assignee: Helmerich & Payne, Inc., Tulsa, OK (US)

( * ) Notice: Subject to any disclaimer, the term of this patent is extended or adjusted under 35 U.S.C. 154(b) by 0 days.

(21) Appl. No.: 18/949,812

(22) Filed: Nov. 15, 2024

(65) Prior Publication Data

US 2025/0163767 A1 May 22, 2025

Related U.S. Application Data

(60) Provisional application No. 63/599,788, filed on Nov. 16, 2023.

(51) Int. Cl.
*E21B 21/01* (2006.01)
*E21B 3/00* (2006.01)

(52) U.S. Cl.
CPC ..... *E21B 21/01* (2013.01); *E21B 3/00* (2013.01)

(58) Field of Classification Search
CPC ..... E21B 43/2607
See application file for complete search history.

(56) References Cited

U.S. PATENT DOCUMENTS 3,595,075 A * 7/1971 Dower ..... E21B 47/06 73/152.19
6,264,437 B1 * 7/2001 Porel ..... F02M 59/14 417/387
6,327,960 B1 * 12/2001 Heimueller ..... F04B 43/0063 92/98 R
10,724,315 B2 7/2020 Leuchtenberg
11,448,205 B2 9/2022 Meinz et al.
(Continued)

FOREIGN PATENT DOCUMENTS

GB 2103726 A 2/1983
NO 166143 B 2/1991

OTHER PUBLICATIONS

PCT/US2024/056292, "International Search Report and Written Opinion", Jan. 27, 2025, 11 pages.

*Primary Examiner* — David Carroll
(74) *Attorney, Agent, or Firm* — Kilpatrick Townsend & Stockton LLP

(57) ABSTRACT

A drill rig may include a motor connected to a piston-diaphragm pump configured to: apply a force to a fluid in a cylinder of the piston-diaphragm pump by moving a piston in the cylinder, the fluid filling a void inside the cylinder between a head of the piston and one side of a diaphragm; transfer the force from the fluid across the diaphragm to a drilling mud by flexing the diaphragm, where the drilling mud is separated from the first fluid; and cause a flowrate of the drilling mud through a value connected to the cylinder via a high-pressure piping system into the borehole. The drill rig may direct the mud through a kelly and a pipe to a bottom of the wellbore, force the mud through nozzles located near a bit, rotate the bit, and returning the mud through an annulus to the surface.

33 Claims, 15 Drawing Sheets

(56) References Cited

U.S. PATENT DOCUMENTS

| | | | | |
|---|---|---|---|---|
| 2002/0129943 | A1* | 9/2002 | Maus | E21B 21/082 166/368 |
| 2003/0196804 | A1* | 10/2003 | Riet | E21B 21/106 166/267 |
| 2005/0092523 | A1* | 5/2005 | McCaskill | E21B 21/08 175/218 |
| 2014/0010671 | A1* | 1/2014 | Cryer | B60K 6/485 290/45 |
| 2014/0202702 | A1* | 7/2014 | Cobb | B01F 25/4314 166/307 |
| 2014/0248160 | A1* | 9/2014 | Giessbach | F04B 27/08 417/53 |
| 2018/0038177 | A1* | 2/2018 | Leuchtenberg | E21B 21/08 |
| 2018/0313178 | A1* | 11/2018 | Biggerstaff | E21B 21/12 |
| 2019/0323493 | A1 | 10/2019 | Meinz et al. | |
| 2020/0355173 | A1* | 11/2020 | Wu | F04B 15/02 |
| 2020/0362975 | A1* | 11/2020 | Hurst | F04B 15/02 |
| 2022/0065242 | A1* | 3/2022 | Netecke | F04B 53/006 |
| 2025/0116270 | A1 | 4/2025 | Hembree | |
| 2025/0163767 | A1 | 5/2025 | Draeger et al. | |

* cited by examiner

PISTON-DIAPHRAGM PUMP FOR DRILLING OPERATIONS

CROSS-REFERENCE TO RELATED APPLICATIONS

This application claims the benefit of priority to U.S. Provisional Application No. 63/599,788 filed on Nov. 16, 2023, which is incorporated herein by reference in its entirety for all purposes.

BACKGROUND OF THE INVENTION

A function of a mud pump can supply the drill line with drilling fluid at a specified high pressure (e.g., 3,000 psi-10,000 psi) and a desired flowrate. The industry standard design for mud pumps today is positive displacement pumps (e.g., triplex and quadruplex) which typically employ a simple piston or swab traveling back and forth in a cylinder and in which the fluid is in contact with the piston (hereinafter referred to as a "positive displacement pump"). For example: the piston moves to the bottom of its stroke; which draws in drilling mud through a suction valve at a lower pressure, and then the piston moves to the top of its stroke; forcing that same volume of drilling fluid out of a discharge valve at a higher pressure. Many systems on drilling rigs employ positive displacements pumps of this common design. Also typical of this design is the inherent and necessary wear and tear on the piston and cylinder, which slide back and forth in constant exposure to the abrasive drilling mud slurry. This abrasive environment contributes to accelerated wear and replacement of those pistons and cylinders.

BRIEF SUMMARY OF THE INVENTION

A piston-diaphragm pump, as disclosed herein, in contrast to a positive displacement piston pump in which the fluid is contact with the piston may have a rubberized flexible diaphragm which separates the piston and cylinder from the mud slurry. The operation of the two pumps may be similar, for example, in the piston-diaphragm pump disclosed herein the piston moves back and forth inside the cylinder; but instead of displacing a volume of mud slurry, the cylinder displaces a volume of hydraulic fluid. The hydraulic fluid fills the void between the piston and the diaphragm but maintains a constant volume. When the piston moves to the bottom of its stroke, the diaphragm pulls back into a concave shape corresponding to the same volume displacement. When the piston moves to the top of its stroke, the diaphragm pushes out into a convex shape, again displacing the same volume as the piston. Comparing to the positive displacement piston design, the piston-diaphragm pump disclosed herein design accomplishes the same displacement of drilling fluid, as well as the same typical horsepower, pressure, and flowrates of the common piston cylinder design. However, in the piston diaphragm pump disclosed herein instead of the drilling mud slurry being in direct contact with the piston; it is now in direct contact with the diaphragm only; and the piston and cylinder are now operating in a bath of lubricating oil. Whereas in the positive displacement pump design, the piston and cylinder have a short service life, measured in hours due to the abrasive slurry. Pumping an abrasive medium, such as drilling mud, causes the piston and liner to degrade and wash out such that performance of the piston and liner in conventional mud pumps is typically measured in hundreds of hours. By contrast the piston-diaphragm pump disclosed herein has a much increased service life, for example the service life may be measured in years for the design of the present disclosure (e.g. 2 years, 5 years, 10 years). The piston-diaphragm pump disclosed herein displaces the same amount of drilling fluid by bending—changing its flexible shape from concave to convex—while entirely eliminating the wear and tear of pistons sliding inside cylinders in an abrasive slurry. The design of the piston-diaphragm pump within the mud pump reduces the mechanical and erosive wear on the piston and liner such that the piston and liner last greater than 1,000 hours, preferably nearly or as long as the pump, in some embodiments, upwards of 10 years. In some embodiments, isolating the drilling mud from the piston and liner may allow use of more abrasive drilling mud that is conventionally used.

In some embodiments, the present disclosure provides a method of drilling a borehole, with the method comprising: providing a motor connected to a piston-diaphragm pump configured to apply a pressure to a first fluid in a volume defined within the piston-diaphragm pump by moving a piston in the volume, the first fluid filling a second volume inside the pump between a head of the piston and one side of a diaphragm located within the pump, transfer the pressure from the fluid across the diaphragm to a drilling mud, wherein the drilling mud is separated from the first fluid by the diaphragm, and cause a flowrate of the drilling mud through a valve connected to the pump via a high-pressure piping system into the borehole of a well being drilled. The method can further include: directing the drilling mud through a kelly and a drill string to a bottom of the wellbore, forcing the drilling mud through one or more nozzles of a drill bit at one end of the drill string, drilling the borehole by rotating the drill bit, and returning the drilling mud from the wellbore to the surface. The diaphragm may flex to a concave shape at a bottom of a stroke of the piston and to a convex shape at the top of the stroke of the piston. The first fluid may comprise a lubricating oil. In some embodiments, the force operates in a range between 7,000 pounds per square inch (psi) and up to and including 10,000 psi, and/or the flowrate may operate in a range between 320 and 380 gallons per minute (gpm). In some embodiments, a flow rate of 990 gpm can be provided by multiple mud pumps in parallel.

In other embodiments, a system for supplying pressurized fluid in a borehole during drilling operations is provided, with the system comprising: a cylindrical chamber; a piston connected via an arm to a motor, wherein the piston is sized to travel inside the cylindrical chamber; a first chamber containing a first fluid between a head of the piston and a first side of a diaphragm inside the cylindrical chamber, wherein the piston applies a force to the first fluid which is applied to the first side of the diaphragm; a second chamber containing a second fluid between a second side of the diaphragm and a check valve, wherein movement of the piston causes a flowrate of the second fluid from the second chamber through the check valve to the borehole via piping; and a variable frequency drive connected to the motor. In the system, the diaphragm may be configured to flex to a concave shape at a bottom of a stroke of the piston and to a convex shape at the top of the stroke of the piston. The first fluid may comprise a lubricating oil, and/or the second fluid may be a drilling mud. The system may apply a force in a range between 7,000 psi and 8000 psi, and/or a flowrate of the drilling mud in a range between 320 and 380 gpm.

In some embodiments, a method of drilling a wellbore is provided, wherein the method comprises providing a drilling fluid for drilling a wellbore, providing a pump for pumping the drilling fluid into the wellbore, wherein the pump comprises a diaphragm pump, and operating the pump to pump the drilling fluid into the wellbore, wherein the drilling fluid has a pressure of at least 5,000 psi. The pump may comprise a motor which is operable at least 1,500 horsepower, and/or the drilling fluid may have a flow rate in the wellbore of at least 200 gpm, and/or the drilling fluid may have a pressure of at least 7,000 psi and a flow rate of at least 250 gpm. In some embodiments, the drilling fluid may have a pressure of between 7,000 psi and 8,000 psi and a flow rate of between 250 and 350 gpm, a pressure of 7,500 psi and a flow rate of 330 gpm, or a pressure of between 9,500 psi and 10,500 psi and a flow rate of between 250 and 350 gpm. In some embodiments, the method may further comprise providing two diaphragm pumps for pumping the drilling fluid into the wellbore, providing no more than two diaphragm pumps for pumping the drilling fluid into the wellbore, and/or providing a variable frequency drive coupled to at least one of the pumps. In some embodiments, the method further comprises reducing the time required for maintenance for the diaphragm pump(s) than the time that would otherwise be required for maintenance of one or more piston pumps for pumping the drilling fluid. In some embodiments, the methods of drilling include adjusting one or more drilling parameters, and in turn, adjusting a flow rate and/or pressure of drilling fluid, such as drilling mud, into the borehole. In some embodiments, the flow rate and/or pressure is adjusted by outputting a command to a variable frequency drive that controls operation of one or more mud pumps, such as any of those described herein.

BRIEF DESCRIPTION OF THE DRAWINGS

For a more complete understanding of the present invention and its features and advantages, reference is now made to the following description, taken in conjunction with the accompanying drawings, in which.

Like reference symbols in the various drawings indicate like elements, in accordance with certain example implementations. In addition, multiple instances of an element may be indicated by following a first number for the element with a letter or a hyphen and a second number.

DETAILED DESCRIPTION OF THE INVENTION

Figure 1:
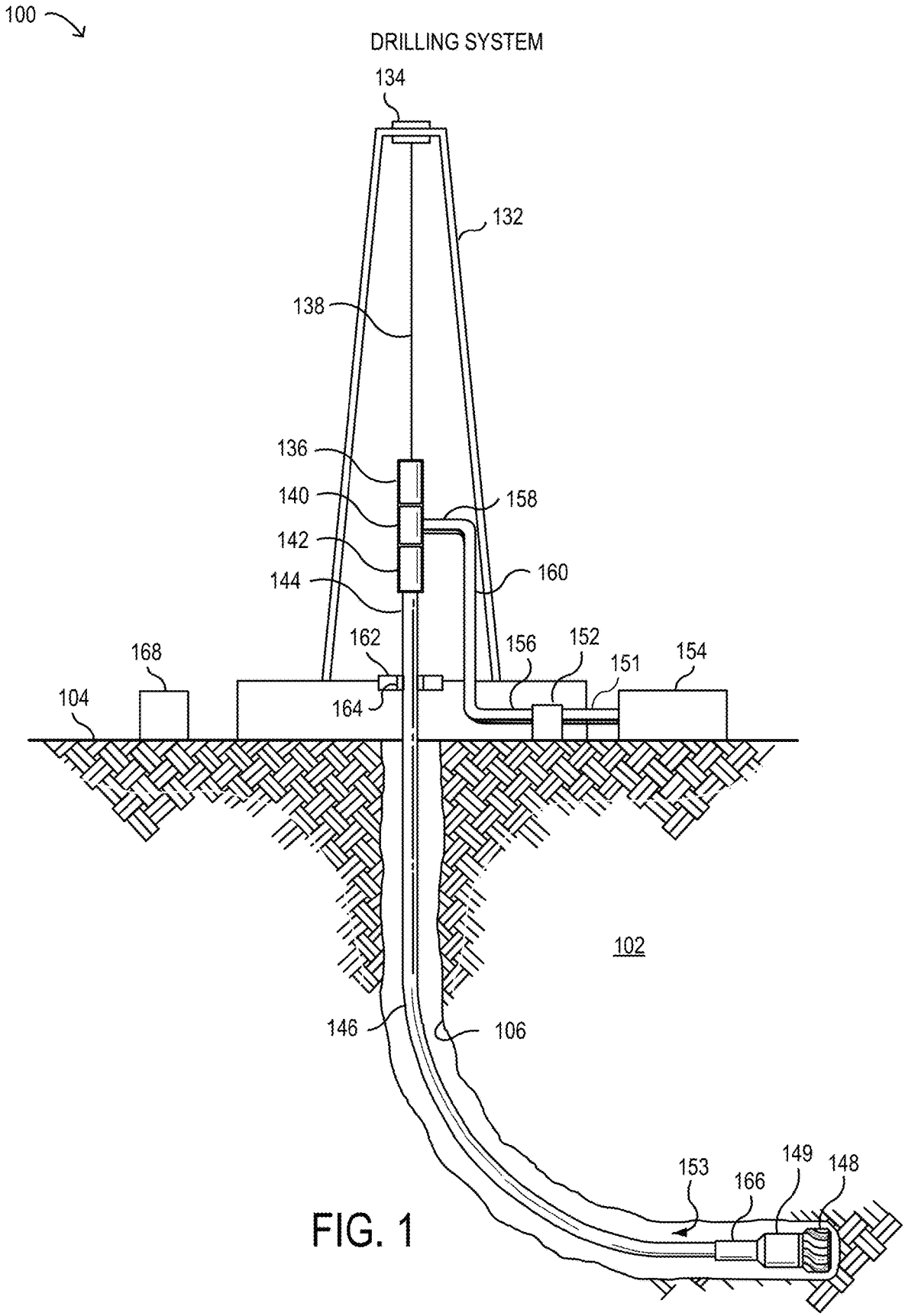
FIG. 1 is a depiction of a drilling system for drilling a borehole.

In the following description, details are set forth by way of example to facilitate discussion of the disclosed subject matter. It is noted, however, that the disclosed embodiments are exemplary and not exhaustive of all possible embodiments.

Throughout this disclosure, a hyphenated form of a reference numeral refers to a specific instance of an element and the un-hyphenated form of the reference numeral refers to the element generically or collectively. Thus, as an example (not shown in the drawings), device "12-1" refers to an instance of a device class, which may be referred to collectively as devices "12" and any one of which may be referred to generically as a device "12". In the figures and the description, like numerals are intended to represent like elements.

Drilling a well typically involves a substantial amount of human decision-making during the drilling process. For example, geologists and drilling engineers use their knowledge, experience, and the available information to make decisions on how to plan the drilling operation, how to accomplish the drilling plan, and how to handle issues that arise during drilling. However, even the best geologists and drilling engineers perform some guesswork due to the unique nature of each borehole. Furthermore, a directional human driller performing the drilling may have drilled other boreholes in the same region and so may have some similar experience. However, during drilling operations, a multitude of input information and other factors may affect a drilling decision being made by a human operator or specialist, such that the amount of information may overwhelm the cognitive ability of the human to properly consider and factor into the drilling decision. Furthermore, the quality or the error involved with the drilling decision may improve with larger amounts of input data being considered, for example, such as formation data from a large number of offset wells. For these reasons, human specialists may be unable to achieve desirable drilling decisions, particularly when such drilling decisions are made under time constraints, such as during drilling operations when continuation of drilling is dependent on the drilling decision and, thus, the entire drilling rig waits idly for the next drilling decision. Furthermore, human decision-making for drilling decisions can result in expensive mistakes because drilling errors can add significant cost to drilling operations. In some cases, drilling errors may permanently lower the output of a well, resulting in substantial long term economic losses due to the lost output of the well.

Therefore, the well plan may be updated based on new stratigraphic information from the wellbore, as it is being drilled. This stratigraphic information can be gained on one hand from measurement while drilling (MWD) and logging while drilling (LWD) sensor data, but could also include other reference well data, such as drilling dynamics data or sensor data giving information, for example, on the hardness of the rock in individual strata layers being drilled through.

A mud pump is a piece of equipment used in drilling operations, specifically in the oil and gas industry. The mud pump is used to generate sufficient hydraulic pressure to transport the drilling mud from the surface down to a bottom of a wellbore and back to the surface. Mud pumps are typically large, high-powered reciprocating pumps that use pistons or plunger-like mechanisms to create high-pressure fluid flow. These pumps are capable of generating substantial hydraulic pressure required for drilling operations.

Mud pumps according to embodiments of the present disclosure provide for high-pressure pumping for efficient mud circulation. The mud pumps include a diaphragm that protects the pump internals from wear and damage. This design offers versatility, reliability, and adaptability, making it a suitable choice for handling drilling mud in various drilling applications. In various embodiments, a two-motor arrangement can power a 2,000-horsepower pump capable of 10,000 psi and 330 gpm. Such pumps can be provided in a three pump skid setup on a variable frequency drive housing that supports six total motors, which can provide a total flowrate of 990 gpm (flowrate being additive as the mud pumps operate in parallel). In various embodiments, lower pressure (e.g., 7,500 psi) piston-diaphragm pumps may be used. In various embodiments, a one-motor arrangement can power a 1,600-horsepower pump capable of 7,500 psi or more and 330 gpm. Such pumps can be provided in a three pump skid setup on a variable frequency drive housing that supports three total motors. Mud pumps disclosed herein can reduce the downtime of the pumps and thereby cost of drilling. In addition, the mud pumps may be in wired or wireless communication with one or more drilling or control systems for transmitting data collected from one or more downhole and/or surface sensors to control parameters, such as differential pressure, flow rate and the like. Differential pressure can be controlled by adjusting the pressure at which drilling mud is delivered into the borehole. The data collected may then be used to update a well plan to reduce costs associated with drilling a wellbore. The mud pump may also be coupled to a mud control system and thereby receive instructions or commands from one or more other drilling or control systems, for controlling the operation of the mud pump.

Referring now to the drawings, Referring to FIG. 1, a drilling system 100 is illustrated in one embodiment as a top drive system. As shown, the drilling system 100 includes a derrick 132 on the surface 104 of the earth and is used to drill a borehole 106 into the earth. Typically, drilling system 100 is used at a location corresponding to a geographic formation 102 in the earth that is known.

In FIG. 1, derrick 132 includes a crown block 134 to which a travelling block 136 is coupled via a drilling line 138. In drilling system 100, a top drive 140 is coupled to travelling block 136 and may provide rotational force for drilling. A saver sub 142 may sit between the top drive 140 and a drill pipe 144 that is part of a drill string 146. Top drive 140 may rotate drill string 146 via the saver sub 142, which in turn may rotate a drill bit 148 of a bottom hole assembly (BHA) 149 in borehole 106 passing through formation 102. Also visible in drilling system 100 is a rotary table 162 that may be fitted with a master bushing 164 to hold drill string 146 when not rotating.

A mud pump unit 152 may direct a fluid mixture 153 (e.g., a drilling fluid, a drilling mud mixture) from a mud pit 154 into drill string 146. Mud pit 154 is shown schematically as a container, but it is noted that various receptacles, tanks, pits, or other containers may be used. Mud 153 may flow from input line 151 into mud pump unit 152 into a discharge line 156 that is coupled to a rotary hose 158 by a standpipe 160. Mud pump unit 152 may include one or more mud pumps, the mud pumps may be piston-diaphragm pumps, such as that shown in FIG. 12. Failure of the mud pump unit 152 may increase the cost associated with drilling the borehole 106 due to the down-time associated with replacing the mud pump unit 152 as well as the cost of the unit. Reducing the frequency of the failure of the mud pump unit 152 may reduce costs associated with drilling the borehole 106. Rotary hose 158 may then be coupled to top drive 140, which includes a passage for mud 153 to flow into borehole 106 via drill string 146 from where mud 153 may emerge at drill bit 148. Mud 153 may lubricate drill bit 148 during drilling and, due to the pressure supplied by mud pump 152, mud 153 may return via borehole 106 to surface 104.

A mud pump is a piece of equipment used in drilling operations, specifically in the oil and gas industry. It plays a vital role in circulating drilling fluid, commonly known as drilling mud, during the drilling process. The primary function of a mud pump is to generate sufficient hydraulic pressure to transport the drilling mud from the surface down to a bottom of a wellbore and back to the surface. Mud pumps are typically large, high-powered reciprocating pumps that use pistons or plunger-like mechanisms to create high-pressure fluid flow. These pumps are capable of generating substantial hydraulic pressure required for drilling operations. The mud pump has two main sections: the suction side and the discharge side. The suction side draws drilling mud from the mud pits or storage tanks through an intake valve. The discharge side pushes the mud through the high-pressure piping system into the drill string.

The drilling mud serves multiple purposes. The mud cools down the drill bit, carries away rock cuttings, lubricates the drill string, provides stability to the wellbore, and counteracts formation pressures to prevent blowouts. The mud pump ensures a continuous circulation of fresh drilling mud to maintain these essential functions. Mud pumps contribute to the overall mud management system. They play a role in controlling mud properties such as density, viscosity, and filtration characteristics. Additionally, the drilling mud is periodically treated with various additives and chemicals to maintain its desired properties, and the mud pump assists in mixing and circulating these additives.

In drilling system 100, drilling equipment (see also FIG. 5) is used to perform the drilling of borehole 106, such as top drive 140 (or rotary drive equipment) that couples to drill string 146 and BHA 149 and is configured to rotate drill string 146 and apply pressure to drill bit 148. Drilling system 100 may include control systems such as a WOB/differential pressure control system 522, a positional/rotary control system 524, a fluid circulation control system 526, and a sensor system 528, as further described below with respect to FIG. 5. The control systems may be used to monitor and change drilling rig settings, such as the WOB or differential pressure to alter the ROP or the radial orientation of the toolface, change the flow rate of drilling mud, and perform other operations. Sensor system 528 may be for obtaining sensor data about the drilling operation and drilling system 100, including the downhole equipment. For example, sensor system 528 may include MWD or logging while drilling (LWD) tools for acquiring information, such as toolface and formation logging information, which may be saved for later retrieval, transmitted with or without a delay using any of various communication means (e.g., wireless, wireline, or mud pulse telemetry), or otherwise transferred to steering control system 168. As used herein, an MWD tool is enabled to communicate downhole measurements without substantial delay to the surface 104, such as using mud pulse telemetry, while a LWD tool is equipped with an internal memory that stores measurements when downhole and can be used to download a stored log of measurements when the LWD tool is at the surface 104. The internal memory in the LWD tool may be a removable memory, such as a universal serial bus (USB) memory device or another removable memory device. It is noted that certain downhole tools may have both MWD and LWD capabilities. Such information acquired by sensor system 528 may include information related to hole depth, bit depth, inclination angle, azimuth angle, true vertical depth, gamma count, standpipe pressure, mud flow rate, rotary rotations per minute (RPM), bit speed, ROP, WOB, among other information. It is noted that all or part of sensor system 528 may be incorporated into a control system, or in another component of the drilling equipment. As drilling system 100 can be configured in many different implementations, it is noted that different control systems and subsystems may be used.

Sensing, detection, measurement, evaluation, storage, alarm, and other functionality may be incorporated into a downhole tool 166 or BHA 149 or elsewhere along drill string 146 to provide downhole surveys of borehole 106. Accordingly, downhole tool 166 may be an MWD tool or a LWD tool or both, and may accordingly utilize connectivity to the surface 104, local storage, or both. In different implementations, gamma ray sensors, magnetometers, accelerometers, and other types of sensors may be used for the downhole surveys. Although downhole tool 166 is shown in singular in drilling system 100, it is noted that multiple instances (not shown) of downhole tool 166 may be located at one or more locations along drill string 146.

In some embodiments, formation detection and evaluation functionality may be provided via a steering control system 168 on the surface 104. Steering control system 168 may be located in proximity to derrick 132 or may be included with drilling system 100. In other embodiments, steering control system 168 may be remote from the actual location of borehole 106 (see also FIG. 4). For example, steering control system 168 may be a stand-alone system or may be incorporated into other systems included with drilling system 100.

In operation, steering control system 168 may be accessible via a communication network (see also FIG. 10) and may accordingly receive formation information via the communication network. In some embodiments, steering control system 168 may use the evaluation functionality to provide corrective measures, such as a convergence plan to overcome an error in the well trajectory of borehole 106 with respect to a reference, or a planned well trajectory. The convergence plans or other corrective measures may depend on a determination of the well trajectory, and therefore, may be improved in accuracy using surface steering, as disclosed herein.

In particular embodiments, at least a portion of steering control system 168 may be located in downhole tool 166 (not shown). In some embodiments, steering control system 168 may communicate with a separate controller (not shown) located in downhole tool 166. In particular, steering control system 168 may receive and process measurements received from downhole surveys and may perform the calculations described herein for surface steering using the downhole surveys and other information referenced herein.

In drilling system 100, to aid in the drilling process, data is collected from borehole 106, such as from sensors in BHA 149, downhole tool 166, or both. The collected data may include the geological characteristics of formation 102 in which borehole 106 was formed, the attributes of drilling system 100, including BHA 149, and drilling information such as weight-on-bit (WOB), drilling speed, and other information pertinent to the formation of borehole 106. The drilling information may be associated with a particular depth or another identifiable marker to index collected data. For example, the collected data for borehole 106 may capture drilling information indicating that drilling of the well from 1,000 feet to 1,200 feet occurred at a first rate of penetration (ROP) through a first rock layer with a first WOB, while drilling from 1,200 feet to 1,500 feet occurred at a second ROP through a second rock layer with a second WOB (see also FIG. 2). In some applications, the collected data may be used to virtually recreate the drilling process that created borehole 106 in formation 102, such as by displaying a computer simulation of the drilling process. The accuracy with which the drilling process can be recreated depends on a level of detail and accuracy of the collected data, including collected data from a downhole survey of the well trajectory.

The collected data may be stored in a database that is accessible via a communication network for example. In some embodiments, the database storing the collected data for borehole 106 may be located locally at drilling system 100, at a drilling hub that supports a plurality of drilling systems 100 in a region, or at a database server accessible over the communication network that provides access to the database (see also FIG. 4). At drilling system 100, the collected data may be stored at the surface 104 or downhole in drill string 146, such as in a memory device included with BHA 149 (see also FIG. 10). Alternatively, at least a portion of the collected data may be stored on a removable storage medium, such as using steering control system 168 or BHA 149 that is later coupled to the database in order to transfer the collected data to the database, which may be manually performed at certain intervals, for example.

In FIG. 1, steering control system 168 is located at or near the surface 104 where borehole 106 is being drilled. Steering control system 168 may be coupled to equipment used in drilling system 100 and may also be coupled to the database, whether the database is physically located locally, regionally, or centrally (see also FIGS. 4 and 5). Accordingly, steering control system 168 may collect and record various inputs, such as measurement data from a magnetometer and an accelerometer that may also be included with BHA 149.

Steering control system 168 may further be used as a surface steerable system, along with the database, as described above. The surface steerable system may enable an operator to plan and control drilling operations while drilling is being performed. The surface steerable system may itself also be used to perform certain drilling operations, such as controlling certain control systems that, in turn, control the actual equipment in drilling system 100 (see also FIG. 5). The control of drilling equipment and drilling operations by steering control system 168 may be manual, manual-assisted, semi-automatic, or automatic, in different embodiments.

Manual control may involve direct control of the drilling rig equipment, albeit with certain safety limits to prevent unsafe or undesired actions or collisions of different equipment. To enable manual-assisted control, steering control system 168 may present various information, such as using a graphical user interface (GUI) displayed on a display device (see FIG. 8), to a human operator, and may provide controls that enable the human operator to perform a control operation. The information presented to the user may include live measurements and feedback from the drilling rig and steering control system 168, or the drilling rig itself, and may further include limits and safety-related elements to prevent unwanted actions or equipment states, in response to a manual control command entered by the user using the GUI.

To implement semi-automatic control, steering control system 168 may itself propose or indicate to the user, such as via the GUI, that a certain control operation, or a sequence of control operations, should be performed at a given time. Then, steering control system 168 may enable the user to imitate the indicated control operation or sequence of control operations, such that once manually started, the indicated control operation or sequence of control operations is automatically completed. The limits and safety features mentioned above for manual control would still apply for semi-automatic control. It is noted that steering control system 168 may execute semi-automatic control using a secondary processor, such as an embedded controller that executes under a real-time operating system (RTOS), that is under the control and command of steering control system 168. To implement automatic control, the step of manual starting the indicated control operation or sequence of operations is eliminated, and steering control system 168 may proceed with a passive notification to the user of the actions taken.

In order to implement various control operations, steering control system 168 may perform (or may cause to be performed) various input operations, processing operations, and output operations. The input operations performed by steering control system 168 may result in measurements or other input information being made available for use in any subsequent operations, such as processing or output operations. The input operations may accordingly provide the input information, including feedback from the drilling process itself, to steering control system 168. The processing operations performed by steering control system 168 may be any processing operation associated with surface steering, as disclosed herein. The output operations performed by steering control system 168 may involve generating output information for use by external entities, or for output to a user, such as in the form of updated elements in the GUI, for example. The output information may include at least some of the input information, enabling steering control system 168 to distribute information among various entities and processors.

In particular, the operations performed by steering control system 168 may include operations such as receiving drilling data representing a drill path, receiving other drilling parameters, calculating a drilling solution for the drill path based on the received data and other available data (e.g., rig characteristics), implementing the drilling solution at the drilling rig, monitoring the drilling process to gauge whether the drilling process is within a defined margin of error of the drill path, and calculating corrections for the drilling process if the drilling process is outside of the margin of error.

Accordingly, steering control system 168 may receive input information either before drilling, during drilling, or after drilling of borehole 106. The input information may comprise measurements from one or more sensors, as well as survey information collected while drilling borehole 106. The input information may also include a well plan, a regional formation history, drilling engineer parameters, downhole tool face/inclination information, downhole tool gamma/resistivity information, economic parameters, reliability parameters, among various other parameters. Some of the input information, such as the regional formation history, may be available from a drilling hub 410, which may have respective access to a regional drilling database (DB) 412 (see FIG. 4). Other input information may be accessed or uploaded from other sources to steering control system 168. For example, a web interface may be used to interact directly with steering control system 168 to upload the well plan or drilling parameters.

As noted, the input information may be provided to steering control system 168. After processing by steering control system 168, steering control system 168 may generate control information that may be output to drilling rig 210 (e.g., to rig controls 520 that control drilling equipment 530, see also FIGS. 2 and 5). Drilling rig 210 may provide feedback information using rig controls 520 to steering control system 168. The feedback information may then serve as input information to steering control system 168, thereby enabling steering control system 168 to perform feedback loop control and validation. Accordingly, steering control system 168 may be configured to modify its output information to drilling rig 210, in order to achieve the desired results, which are indicated in the feedback information. The output information generated by steering control system 168 may include indications to modify one or more drilling parameters, the direction of drilling, and the drilling mode, among others. In certain operational modes, such as semi-automatic or automatic, steering control system 168 may generate output information indicative of instructions to rig controls 520 to enable automatic drilling using the latest location of BHA 149. Therefore, an improved accuracy in the determination of the location of BHA 149 may be provided using steering control system 168, along with the methods and operations for surface steering disclosed herein.

Figure 2:
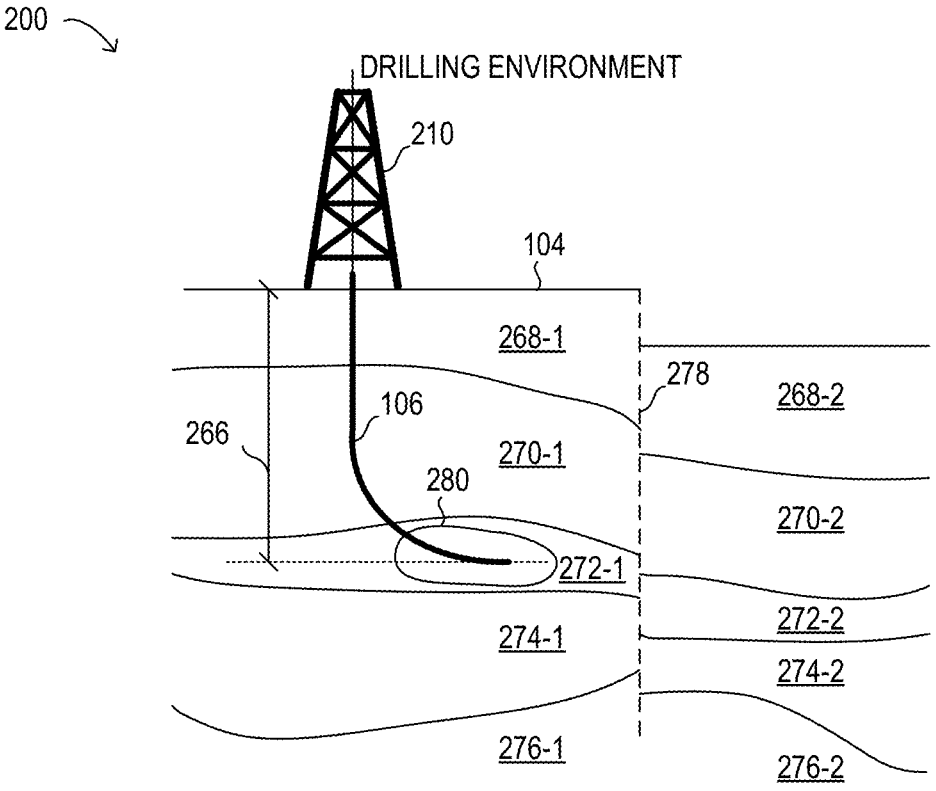
FIG. 2 is a depiction of a drilling environment including the drilling system for drilling a borehole.

Referring now to FIG. 2, a drilling environment 200 is depicted schematically and is not drawn to scale or perspective. In particular, drilling environment 200 may illustrate additional details with respect to formation 102 below the surface 104 in drilling system 100 shown in FIG. 1. In FIG. 2, drilling rig 210 may represent various equipment discussed above with respect to drilling system 100 in FIG. 1 that is located at the surface 104.

In drilling environment 200, it may be assumed that a drilling plan (also referred to as a well plan) has been formulated to drill borehole 106 extending into the ground to a true vertical depth (TVD) 266 and penetrating several subterranean strata layers. Borehole 106 is shown in FIG. 2 extending through strata layers 268-1 and 270-1, while terminating in strata layer 272-1. Accordingly, as shown, borehole 106 does not extend or reach underlying strata layers 274-1 and 276-1. A target area 280 specified in the drilling plan may be located in strata layer 272-1 as shown in FIG. 2. Target area 280 may represent a desired endpoint of borehole 106, such as a hydrocarbon producing area indicated by strata layer 272-1. It is noted that target area 280 may be of any shape and size and may be defined using various different methods and information in different embodiments. In some instances, target area 280 may be specified in the drilling plan using subsurface coordinates, or references to certain markers, which indicate where borehole 106 is to be terminated. In other instances, target area may be specified in the drilling plan using a depth range within which borehole 106 is to remain. For example, the depth range may correspond to strata layer 272-1. In other examples, target area 280 may extend as far as can be realistically drilled. For example, when borehole 106 is specified to have a horizontal section with a goal to extend into strata layer 172 as far as possible, target area 280 may be defined as strata layer 272-1 itself and drilling may continue until some other physical limit is reached, such as a property boundary or a physical limitation to the length of drill string 146.

Also visible in FIG. 2 is a fault line 278 that has resulted in a subterranean discontinuity in the fault structure. Specifically, strata layers 268, 270, 272, 274, and 276 have portions on either side of fault line 278. On one side of fault line 278, where borehole 106 is located, strata layers 268-1, 270-1, 272-1, 274-1, and 276-1 are unshifted by fault line 278. On the other side of fault line 278, strata layers 268-2, 270-2, 272-2, 274-2, and 276-2 are shifted downwards by fault line 278.

Current drilling operations frequently include directional drilling to reach a target, such as target area 280. The use of directional drilling has been found to generally increase an overall amount of production volume per well, but also may lead to significantly higher production rates per well, which are both economically desirable. As shown in FIG. 2, directional drilling may be used to drill the horizontal portion of borehole 106, which increases an exposed length of borehole 106 within strata layer 272-1, and which may accordingly be beneficial for hydrocarbon extraction from strata layer 272-1. Directional drilling may also be used to alter an angle of borehole 106 to accommodate subterranean faults, such as indicated by fault line 278 in FIG. 1. Other benefits that may be achieved using directional drilling include sidetracking off of an existing well to reach a different target area or a missed target area, drilling around abandoned drilling equipment, drilling into otherwise inaccessible or difficult to reach locations (e.g., underpopulated areas or bodies of water), providing a relief well for an existing well, and increasing the capacity of a well by branching off and having multiple boreholes extending in different directions or at different vertical positions for the same well. Directional drilling is often not limited to a straight horizontal borehole 106 but may involve staying within a strata layer that varies in depth and thickness as illustrated by strata layer 272. As such, directional drilling may involve multiple vertical adjustments that complicate the trajectory of borehole 106.

Figure 3:
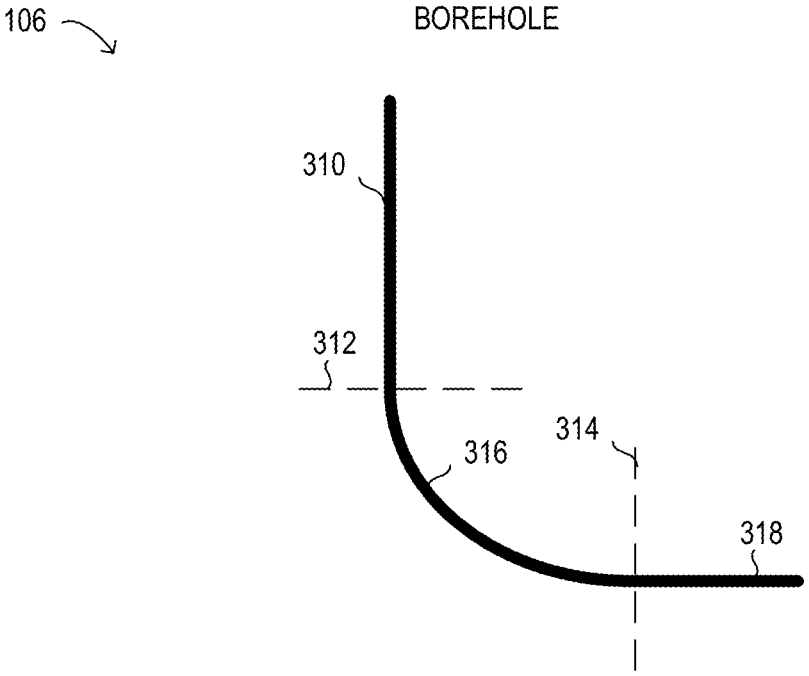
FIG. 3 is a depiction of a borehole generated in the drilling environment.

Referring now to FIG. 3, one embodiment of a portion of borehole 106 is shown in further detail. Using directional drilling for horizontal drilling may introduce certain challenges or difficulties that may not be observed during vertical drilling of borehole 106. For example, a horizontal portion 318 of borehole 106 may be started from a vertical portion 310. In order to make the transition from vertical to horizontal, a curve may be defined that specifies a so-called "build up" section 316. Build up section 316 may begin at a kickoff point 312 in vertical portion 310 and may end at a begin point 314 of horizontal portion 318. The change in inclination angle in buildup section 316 per measured length drilled is referred to herein as a "build rate" and may be defined in degrees per one hundred feet drilled. For example, the build rate may have a value of 6°/100 ft., indicating that there is a six-degree change in inclination angle for every one hundred feet drilled. The build rate for a particular build up section may remain relatively constant or may vary.

The build rate used for any given build up section may depend on various factors, such as properties of the formation (i.e., strata layers) through which borehole 106 is to be drilled, the trajectory of borehole 106, the particular pipe and drill collars/BHA components used (e.g., length, diameter, flexibility, strength, mud motor bend setting, and drill bit), the mud type and flow rate, the specified horizontal displacement, stabilization, and inclination angle, among other factors. An overly aggressive built rate can cause problems such as severe doglegs (e.g., sharp changes in direction in the borehole) that may make it difficult or impossible to run casing or perform other operations in borehole 106. Depending on the severity of any mistakes made during directional drilling, borehole 106 may be enlarged or drill bit 146 may be backed out of a portion of borehole 106 and re-drilled along a different path. Such mistakes may be undesirable due to the additional time and expense involved. However, if the built rate is too cautious, additional overall time may be added to the drilling process because directional drilling generally involves a lower ROP than straight drilling. Furthermore, directional drilling for a curve is more complicated than vertical drilling and the possibility of drilling errors increases with directional drilling (e.g., overshoot and undershoot that may occur while trying to keep drill bit 148 on the planned trajectory).

Two modes of drilling, referred to herein as "rotating" and "sliding," are commonly used to form borehole 106. Rotating, also called "rotary drilling," uses top drive 140 or rotary table 162 to rotate drill string 146. Rotating may be used when drilling occurs along a straight trajectory, such as for vertical portion 310 of borehole 106. Sliding, also called "steering" or "directional drilling" as noted above, typically uses a mud motor located downhole at BHA 149. The mud motor may have an adjustable bent housing and is not powered by rotation of drill string 146. Instead, the mud motor uses hydraulic power derived from the pressurized drilling mud that circulates along borehole 106 to and from the surface 104 to directionally drill borehole 106 in buildup section 316.

Thus, sliding is used in order to control the direction of the well trajectory during directional drilling. A method to perform a slide may include the following operations. First, during vertical or straight drilling, the rotation of drill string 146 is stopped. Based on feedback from measuring equipment, such as from downhole tool 166, adjustments may be made to drill string 146, such as using top drive 140 to apply various combinations of torque, WOB, and vibration, among other adjustments. The adjustments may continue until a tool face is confirmed that indicates a direction of the bend of the mud motor is oriented to a direction of a desired deviation (i.e., build rate) of borehole 106. Once the desired orientation of the mud motor is attained, WOB to the drill bit is increased, which causes the drill bit to move in the desired direction of deviation. Once sufficient distance and angle have been built up in the curved trajectory, a transition back to rotating mode can be accomplished by rotating drill string 146 again. The rotation of drill string 146 after sliding may neutralize the directional deviation caused by the bend in the mud motor due to the continuous rotation around a centerline of borehole 106.

Figure 4:
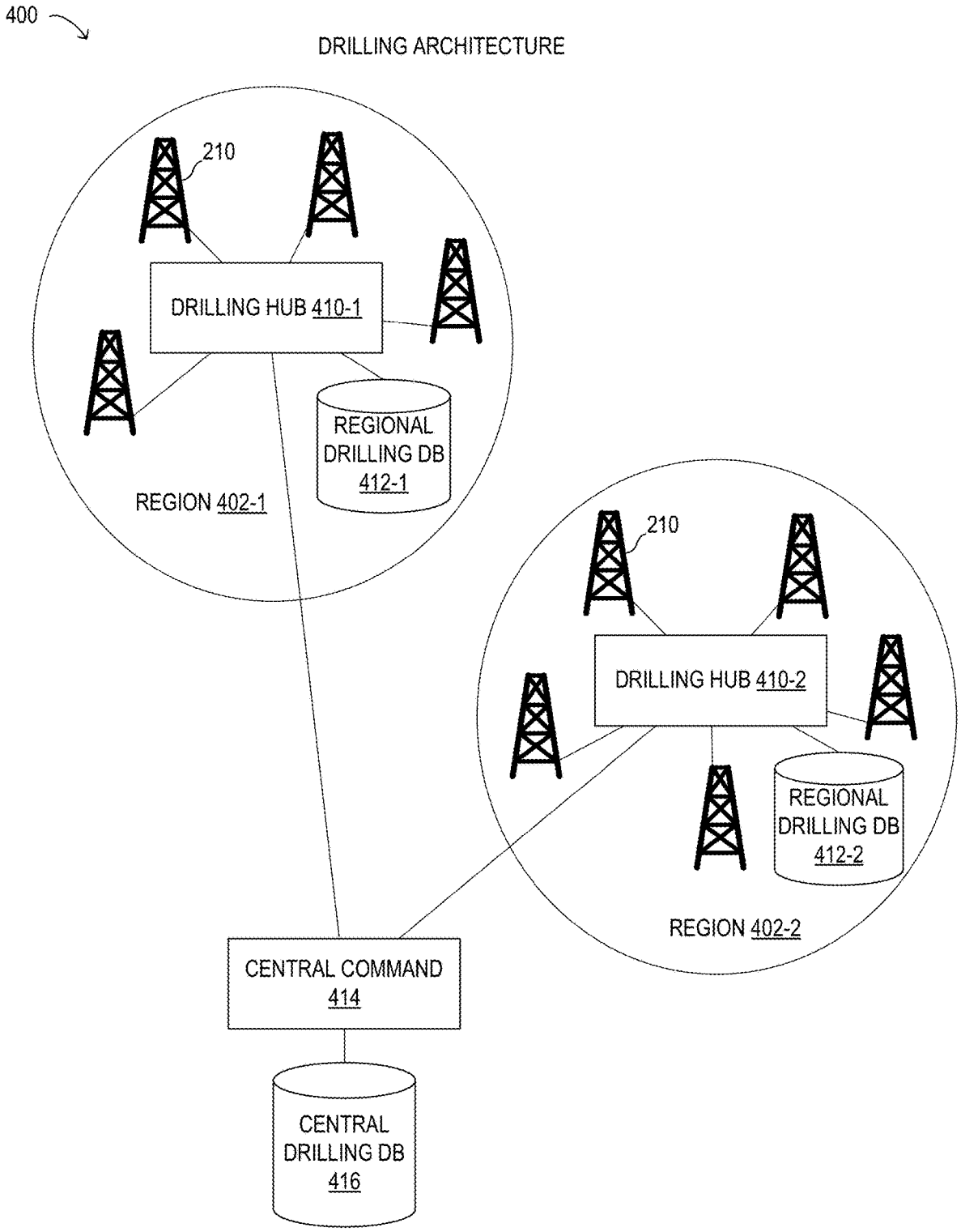
FIG. 4 is a depiction of a drilling architecture including the drilling environment.

Referring now to FIG. 4, a drilling architecture 400 is illustrated in diagram form. As shown, drilling architecture 400 depicts a hierarchical arrangement of drilling hubs 410 and a central command 414, to support the operation of a plurality of drilling rigs 210 in different regions 402. Specifically, as described above with respect to FIGS. 1 and 2, drilling rig 210 includes steering control system 168 that is enabled to perform various drilling control operations locally to drilling rig 210. When steering control system 168 is enabled with network connectivity, certain control operations or processing may be requested or queried by steering control system 168 from a remote processing resource. As shown in FIG. 4, drilling hubs 410 represent a remote processing resource for steering control system 168 located at respective regions 402, while central command 414 may represent a remote processing resource for both drilling hub 410 and steering control system 168.

Specifically, in a region 402-1, a drilling hub 410-1 may serve as a remote processing resource for drilling rigs 210 located in region 402-1, which may vary in number and are not limited to the exemplary schematic illustration of FIG. 4. Additionally, drilling hub 410-1 may have access to a regional drilling DB 412-1, which may be local to drilling hub 410-1. Additionally, in a region 402-2, a drilling hub 410-2 may serve as a remote processing resource for drilling rigs 210 located in region 402-2, which may vary in number and are not limited to the exemplary schematic illustration of FIG. 4. Additionally, drilling hub 410-2 may have access to a regional drilling DB 412-2, which may be local to drilling hub 410-2.

In FIG. 4, respective regions 402 may exhibit the same or similar geological formations. Thus, reference wells, or offset wells, may exist in a vicinity of a given drilling rig 210 in region 402, or where a new well is planned in region 402. Furthermore, multiple drilling rigs 210 may be actively drilling concurrently in region 402 and may be in different stages of drilling through the depths of formation strata layers at region 402. Thus, for any given well being drilled by drilling rig 210 in a region 402, survey data from the reference wells or offset wells may be used to create the well plan, and may be used for surface steering, as disclosed herein. In some implementations, survey data or reference data from a plurality of reference wells may be used to improve drilling performance, such as by reducing an error in estimating TVD or a position of BHA 149 relative to one or more strata layers, as will be described in further detail herein. Additionally, survey data from recently drilled wells, or wells still currently being drilled, including the same well, may be used for reducing an error in estimating TVD or a position of BHA 149 relative to one or more strata layers.

Also shown in FIG. 4 is central command 414, which has access to central drilling DB 416, and may be located at a centralized command center that is in communication with drilling hubs 410 and drilling rigs 210 in various regions 402. The centralized command center may have the ability to monitor drilling and equipment activity at any one or more drilling rigs 210. In some embodiments, central command 414 and drilling hubs 412 may be operated by a commercial operator of drilling rigs 210 as a service to customers who have hired the commercial operator to drill wells and provide other drilling-related services.

In FIG. 4, it is particularly noted that central drilling DB 416 may be a central repository that is accessible to drilling hubs 410 and drilling rigs 210. Accordingly, central drilling DB 416 may store information for various drilling rigs 210 in different regions 402. In some embodiments, central drilling DB 416 may serve as a backup for at least one regional drilling DB 412 or may otherwise redundantly store information that is also stored on at least one regional drilling DB 412. In turn, regional drilling DB 412 may serve as a backup or redundant storage for at least one drilling rig 210 in region 402. For example, regional drilling DB 412 may store information collected by steering control system 168 from drilling rig 210.

In some embodiments, the formulation of a drilling plan for drilling rig 210 may include processing and analyzing the collected data in regional drilling DB 412 to create a more effective drilling plan. Furthermore, once the drilling has begun, the collected data may be used in conjunction with current data from drilling rig 210 to improve drilling decisions. As noted, the functionality of steering control system 168 may be provided at drilling rig 210, or may be provided, at least in part, at a remote processing resource, such as drilling hub 410 or central command 414.

As noted, steering control system 168 may provide functionality as a surface steerable system for controlling drilling rig 210. Steering control system 168 may have access to regional drilling DB 412 and central drilling DB 416 to provide the surface steerable system functionality. As will be described in greater detail below, steering control system 168 may be used to plan and control drilling operations based on input information, including feedback from the drilling process itself. Steering control system 168 may be used to perform operations such as receiving drilling data representing a drill trajectory and other drilling parameters, calculating a drilling solution for the drill trajectory based on the received data and other available data (e.g., rig characteristics), implementing the drilling solution at drilling rig 210, monitoring the drilling process to gauge whether the drilling process is within a margin of error that is defined for the drill trajectory, or calculating corrections for the drilling process if the drilling process is outside of the margin of error.

Figure 5:
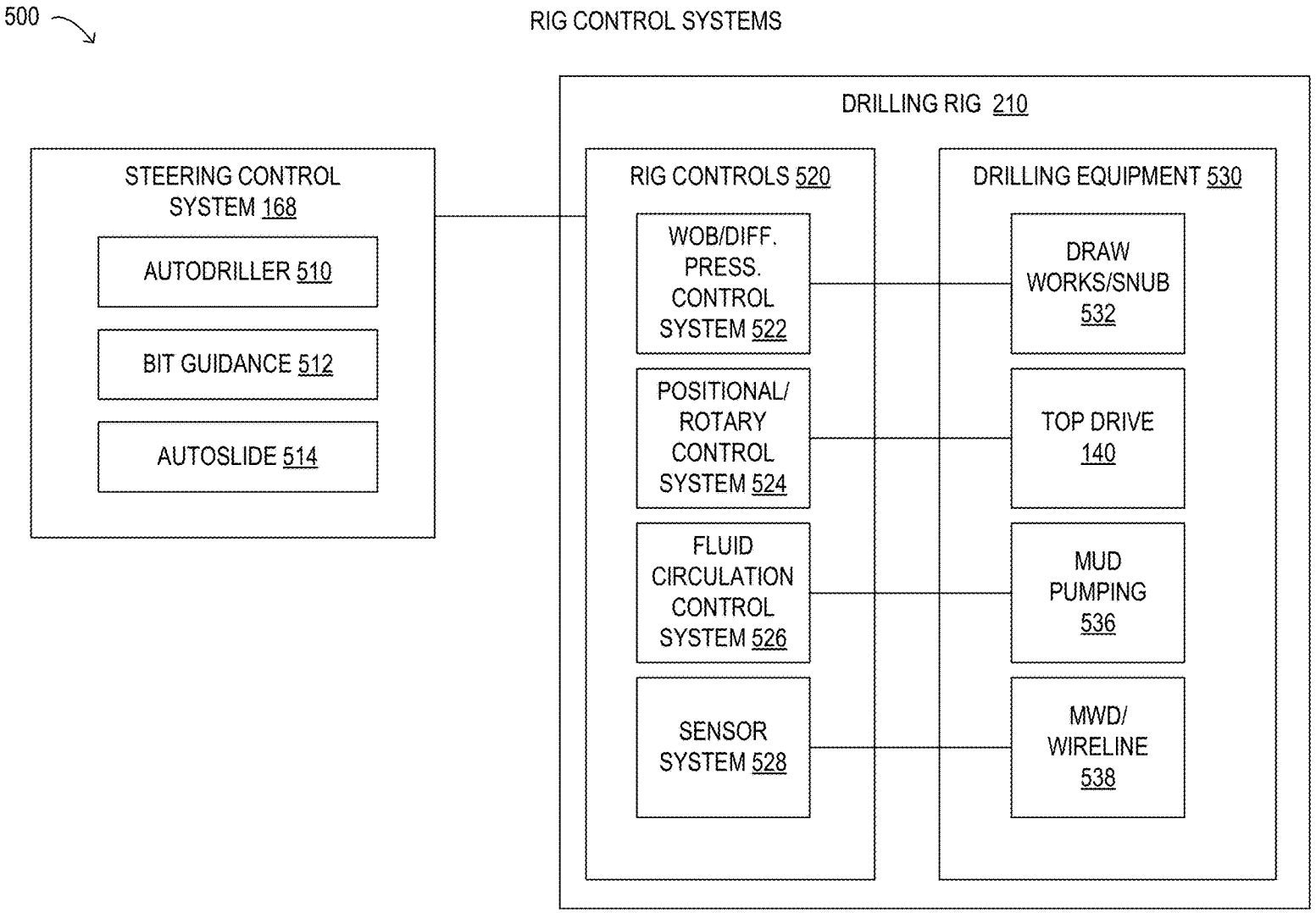
FIG. 5 is a depiction of rig control systems included in the drilling system.

Referring now to FIG. 5, an example of rig control systems 500 is illustrated in schematic form. It is noted that rig control systems 500 may include fewer or more elements than shown in FIG. 5 in different embodiments. As shown, rig control systems 500 includes steering control system 168 and drilling rig 210. Specifically, steering control system 168 is shown with logical functionality including an autodriller 510, a bit guidance 512, and an autoslide 514. Drilling rig 210 is hierarchically shown including rig controls 520, which provide secure control logic and processing capability, along with drilling equipment 530, which represents the physical equipment used for drilling at drilling rig 210. As shown, rig controls 520 include WOB/differential pressure control system 522, positional/rotary control system 524, fluid circulation control system 526, and sensor system 528, while drilling equipment 530 includes a draw works/snub 532, top drive 140, a mud pumping 536, and an MWD/wireline 538.

Figure 10:
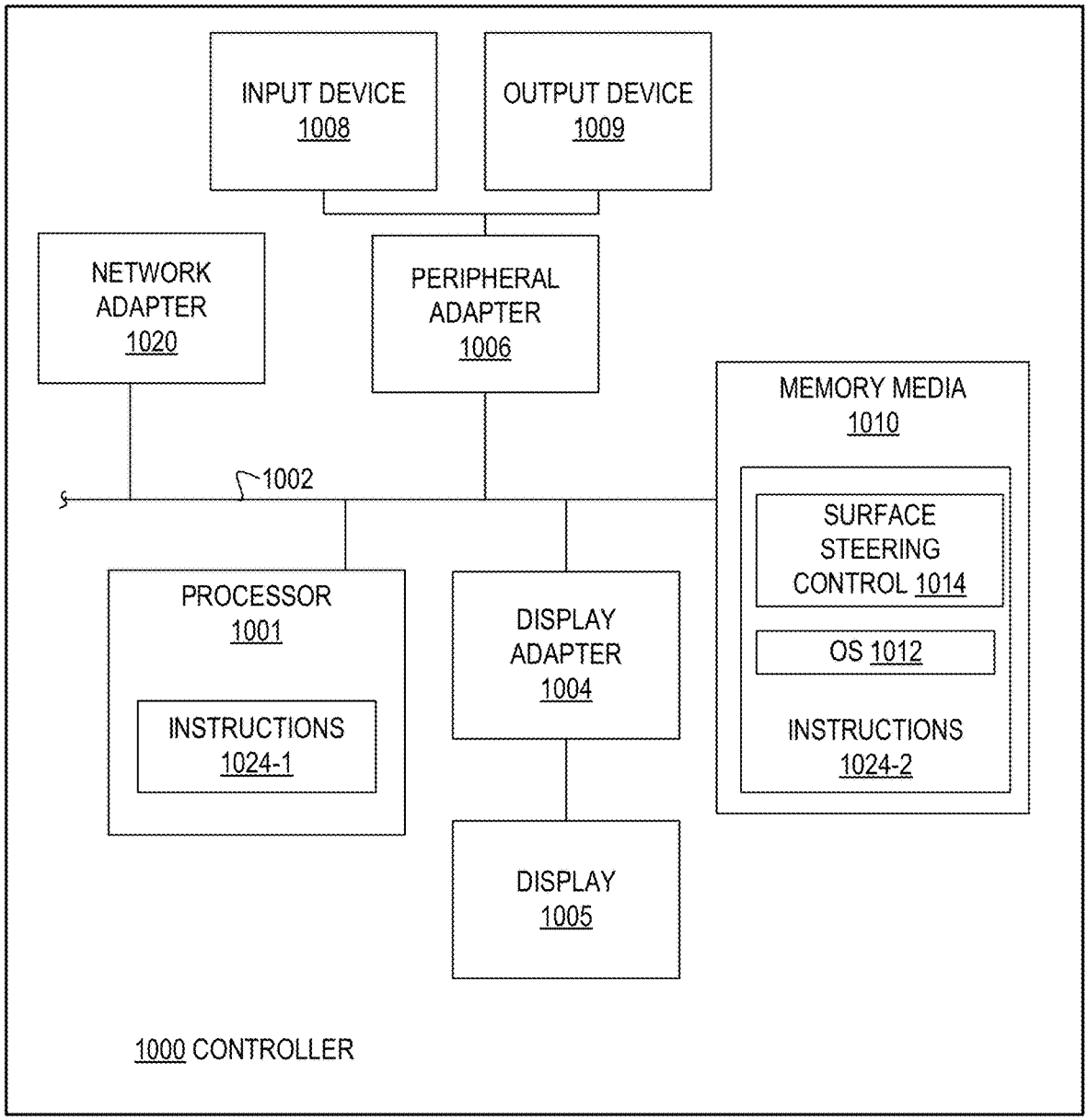
FIG. 10 is a depiction of a controller usable by the rig control systems.

Steering control system 168 represent an instance of a processor having an accessible memory storing instructions executable by the processor, such as an instance of controller 1000 shown in FIG. 10. Also, WOB/differential pressure control system 522, positional/rotary control system 524, and fluid circulation control system 526 may each represent an instance of a processor having an accessible memory storing instructions executable by the processor, such as an instance of controller 1000 shown in FIG. 10, but for example, in a configuration as a programmable logic controller (PLC) that may not include a user interface but may be used as an embedded controller. Accordingly, it is noted that each of the systems included in rig controls 520 may be a separate controller, such as a PLC, and may autonomously operate, at least to a degree. Steering control system 168 may represent hardware that executes instructions to implement a surface steerable system that provides feedback and automation capability to an operator, such as a driller. For example, steering control system 168 may cause autodriller 510, bit guidance 512 (also referred to as a bit guidance system (BGS)), and autoslide 514 (among others, not shown) to be activated and executed at an appropriate time during drilling. In particular implementations, steering control system 168 may be enabled to provide a user interface during drilling, such as the user interface 850 depicted and described below with respect to FIG. 8. Accordingly, steering control system 168 may interface with rig controls 520 to facilitate manual, assisted manual, semi-automatic, and automatic operation of drilling equipment 530 included in drilling rig 210. It is noted that rig controls 520 may also accordingly be enabled for manual or user-controlled operation of drilling and may include certain levels of automation with respect to drilling equipment 530.

In rig control systems 500 of FIG. 5, WOB/differential pressure control system 522 may be interfaced with draw works/snubbing unit 532 to control WOB of drill string 146. Positional/rotary control system 524 may be interfaced with top drive 140 to control rotation of drill string 146. Fluid circulation control system 526 may be interfaced with mud pumping 536 to control mud flow and may also receive and decode mud telemetry signals. Sensor system 528 may be interfaced with MWD/wireline 538, which may represent various BHA sensors and instrumentation equipment, among other sensors that may be downhole or at the surface.

In rig control systems 500, autodriller 510 may represent an automated rotary drilling system and may be used for controlling rotary drilling. Accordingly, autodriller 510 may enable automate operation of rig controls 520 during rotary drilling, as indicated in the well plan. Bit guidance 512 may represent an automated control system to monitor and control performance and operation drilling bit 148.

In rig control systems 500, autoslide 514 may represent an automated slide drilling system and may be used for controlling slide drilling. Accordingly, autoslide 514 may enable automate operation of rig controls 520 during a slide and may return control to steering control system 168 for rotary drilling at an appropriate time, as indicated in the well plan. In particular implementations, autoslide 514 may be enabled to provide a user interface during slide drilling to specifically monitor and control the slide. For example, autoslide 514 may rely on bit guidance 512 for orienting a tool face and on autodriller 510 to set WOB or control rotation or vibration of drill string 146.

Figure 6:
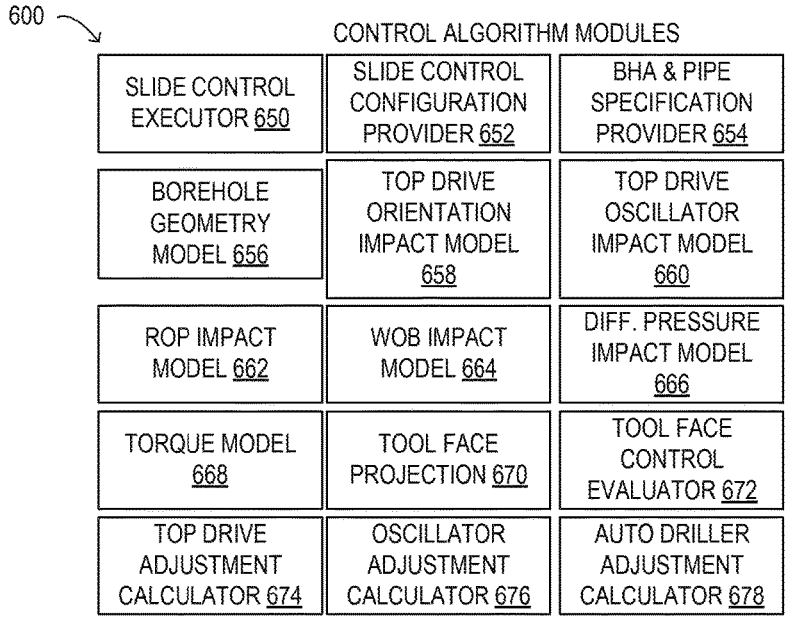
FIG. 6 is a depiction of algorithm modules used by the rig control systems.

FIG. 6 illustrates one embodiment of control algorithm modules 600 used with steering control system 168. The control algorithm modules 600 of FIG. 6 include: a slide control executor 650 that is responsible for managing the execution of the slide control algorithms; a slide control configuration provider 652 that is responsible for validating, maintaining, and providing configuration parameters for the other software modules; a BHA & pipe specification provider 654 that is responsible for managing and providing details of BHA 149 and drill string 146 characteristics; a borehole geometry model 656 that is responsible for keeping track of the borehole geometry and providing a representation to other software modules; a top drive orientation impact model 658 that is responsible for modeling the impact that changes to the angular orientation of top drive 140 have had on the tool face control; a top drive oscillator impact model 660 that is responsible for modeling the impact that oscillations of top drive 140 has had on the tool face control; an ROP impact model 662 that is responsible for modeling the effect on the tool face control of a change in ROP or a corresponding ROP set point; a WOB impact model 664 that is responsible for modeling the effect on the tool face control of a change in WOB or a corresponding WOB set point; a differential pressure impact model 666 that is responsible for modeling the effect on the tool face control of a change in differential pressure (DP) or a corresponding DP set point; a torque model 668 that is responsible for modeling the comprehensive representation of torque for surface, downhole, break over, and reactive torque, modeling impact of those torque values on tool face control, and determining torque operational thresholds; a tool face control evaluator 672 that is responsible for evaluating factors impacting tool face control and whether adjustments need to be projected, determining whether re-alignment off-bottom is indicated, and determining off-bottom tool face operational threshold windows; a tool face projection 670 that is responsible for projecting tool face behavior for top drive 140, the top drive oscillator, and auto driller adjustments; a top drive adjustment calculator 674 that is responsible for calculating top drive adjustments resultant to tool face projections; an oscillator adjustment calculator 676 that is responsible for calculating oscillator adjustments resultant to tool face projections; and an autodriller adjustment calculator 678 that is responsible for calculating adjustments to autodriller 510 resultant to tool face projections.

Figure 7:
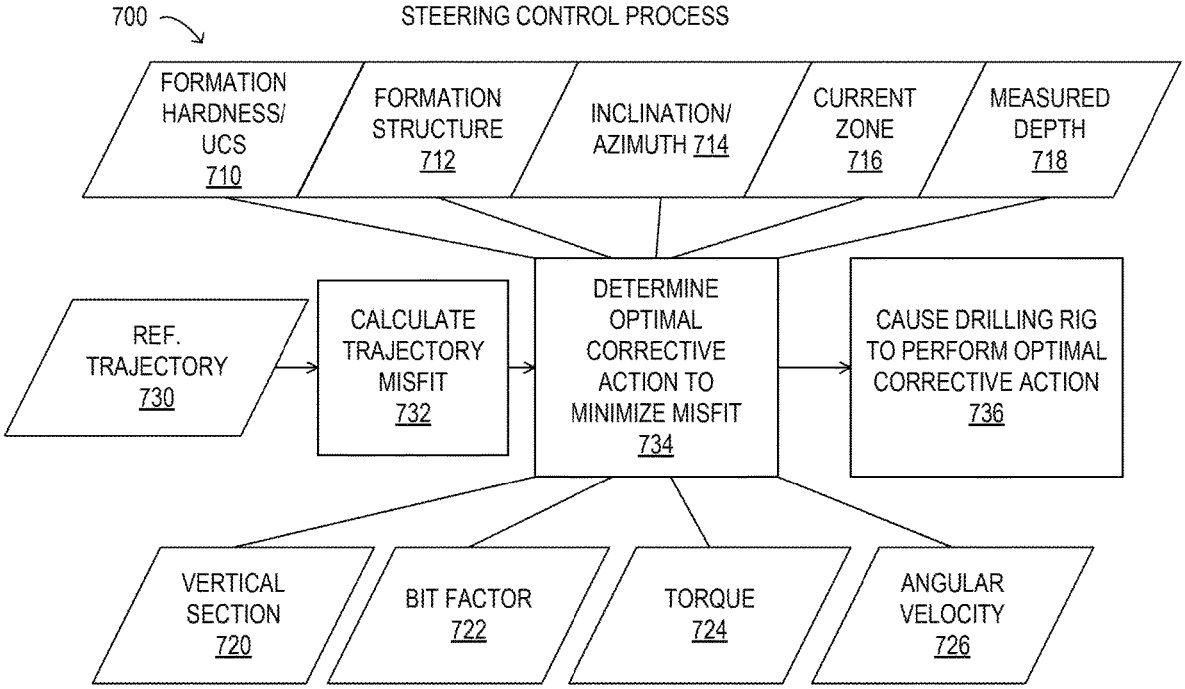
FIG. 7 is a depiction of a steering control process used by the rig control systems.

FIG. 7 illustrates one embodiment of a steering control process 700 for determining a corrective action for drilling. Steering control process 700 may be used for rotary drilling or slide drilling in different embodiments.

Steering control process 700 in FIG. 7 illustrates a variety of inputs that can be used to determine an optimum corrective action. As shown in FIG. 7, the inputs include formation hardness/unconfined compressive strength (UCS) 710, formation structure 712, inclination/azimuth 714, current zone 716, measured depth 718, desired tool face 730, vertical section 720, bit factor 722, mud motor torque 724, reference trajectory 730, vertical section 720, bit factor 722, torque 724 and angular velocity 726. In FIG. 7, reference trajectory 730 of borehole 106 is determined to calculate a trajectory misfit in a step 732. Step 732 may output the trajectory misfit to determine a corrective action to minimize the misfit at step 734, which may be performed using the other inputs described above. Then, at step 736, the drilling rig is caused to perform the corrective action.

It is noted that in some implementations, at least certain portions of steering control process 700 may be automated or performed without user intervention, such as using rig control systems 700 (see FIG. 7). In other implementations, the corrective action in step 736 may be provided or communicated (by display, SMS message, email, or otherwise) to one or more human operators, who may then take appropriate action. The human operators may be members of a rig crew, which may be located at or near drilling rig 210 or may be located remotely from drilling rig 210.

Figure 8:
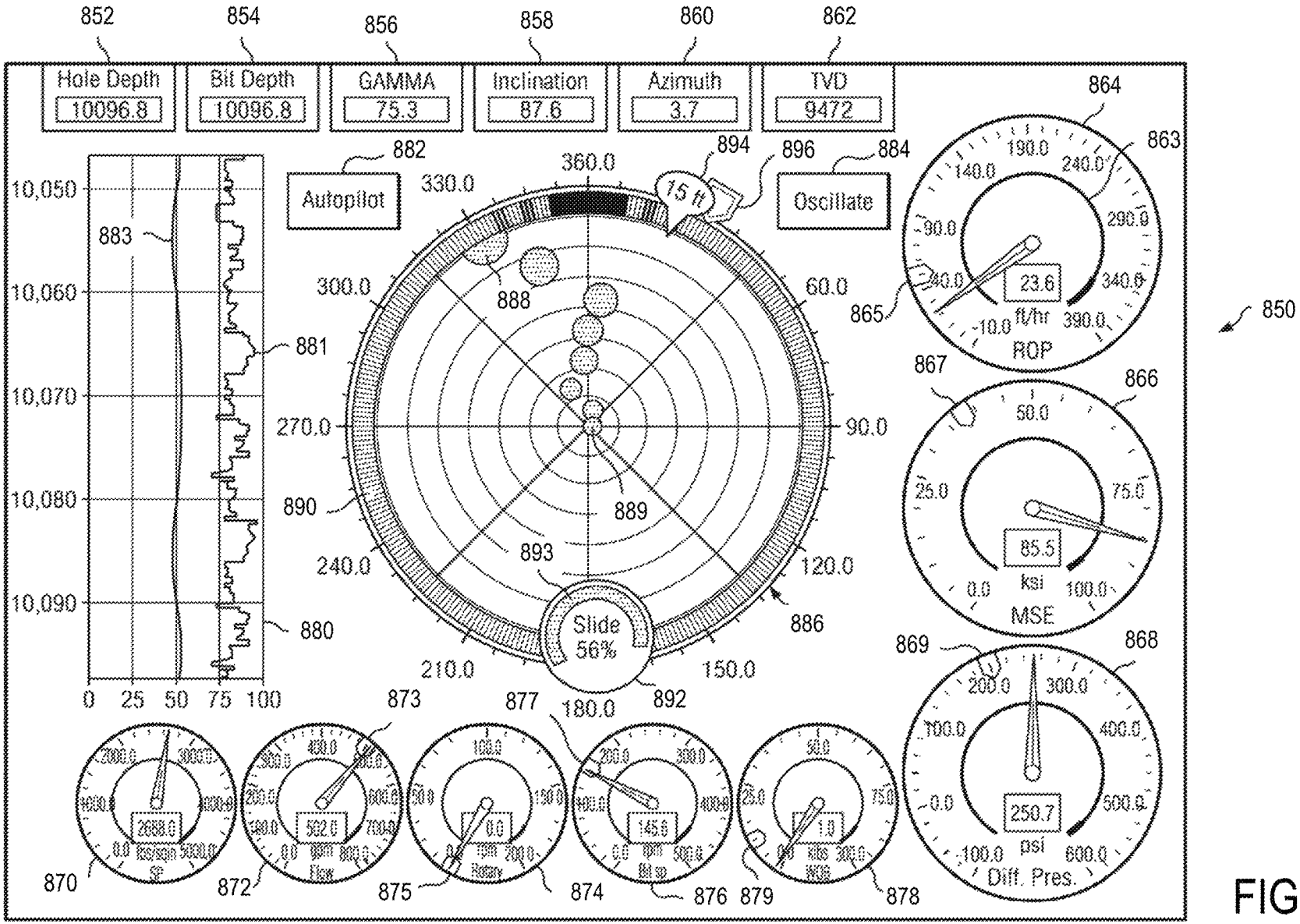
FIG. 8 is a depiction of a graphical user interface provided by the rig control systems.

Referring to FIG. 8, one embodiment of a user interface 850 that may be generated by steering control system 168 for monitoring and operation by a human operator is illustrated. User interface 850 may provide many different types of information in an easily accessible format. For example, user interface 850 may be shown on a computer monitor, a television, a viewing screen (e.g., a display device) associated with steering control system 168.

As shown in FIG. 8, user interface 850 provides visual indicators such as a hole depth indicator 852, a bit depth indicator 854, a GAMMA indicator 856, an inclination indicator 858, an azimuth indicator 860, and a TVD indicator 862. Other indicators may also be provided, including a ROP indicator 864, a mechanical specific energy (MSE)

indicator 866, a differential pressure indicator 868, a standpipe pressure indicator 870, a flow rate indicator 872, a rotary RPM (angular velocity) indicator 874, a bit speed indicator 876, and a WOB indicator 878.

In FIG. 8, at least some of indicators 864, 866, 868, 870, 872, 874, 876, and 878 may include a marker representing a target value. For example, markers may be set as certain given values, but it is noted that any desired target value may be used. Although not shown, in some embodiments, multiple markers may be present on a single indicator. The markers may vary in color or size. For example, ROP indicator 864 may include a marker 865 indicating that the target value is 50 feet/hour (or 15 m/h). MSE indicator 866 may include a marker 867 indicating that the target value is 37 kilo-pounds per square inch (ksi) (or 255 MegaPascals (MPa)). Differential pressure indicator 868 may include a marker 869 indicating that the target value is 200 psi (or 1.38 kPa). ROP indicator 864 may include a marker 865 indicating that the target value is 50 feet/hour (or 15 m/h). Standpipe pressure indicator 870 may have no marker in the present example. Flow rate indicator 872 may include a marker 873 indicating that the target value is 500 gpm (or 31.5 Liters per second (L/s)). Rotary RPM indicator 874 may include a marker 875 indicating that the target value is 0 RPM (e.g., due to sliding). Bit speed indicator 876 may include a marker 877 indicating that the target value is 150 RPM. WOB indicator 878 may include a marker 879 indicating that the target value is 10 kilo-pounds (klbs) (or 4,500 kilograms (kg)). Each indicator may also include a colored band, or another marking, to indicate, for example, whether the respective gauge value is within a safe range (e.g., indicated by a green color), within a caution range (e.g., indicated by a yellow color), or within a danger range (e.g., indicated by a red color).

In FIG. 8, a log chart 880 may visually indicate depth versus one or more measurements (e.g., may represent log inputs relative to a progressing depth chart). For example, log chart 880 may have a Y-axis representing depth and an X-axis representing a measurement such as GAMMA count 881 (as shown), ROP 883 (e.g., empirical ROP and normalized ROP), or resistivity. An autopilot button 882 and an oscillate button 884 may be used to control activity. For example, autopilot button 882 may be used to engage or disengage autodriller 510, while oscillate button 884 may be used to directly control oscillation of drill string 146 or to engage/disengage an external hardware device or controller.

In FIG. 8, a circular chart 886 may provide current and historical tool face orientation information (e.g., which way the bend is pointed). For purposes of illustration, circular chart 886 represents three hundred and sixty degrees. A series of circles within circular chart 886 may represent a timeline of tool face orientations, with the sizes of the circles indicating the temporal position of each circle. For example, larger circles may be more recent than smaller circles, so a largest circle 888 may be the newest reading and a smallest circle 889 may be the oldest reading. In other embodiments, circles 889, 888 may represent the energy or progress made via size, color, shape, a number within a circle, etc. For example, a size of a particular circle may represent an accumulation of orientation and progress for the period of time represented by the circle. In other embodiments, concentric circles representing time (e.g., with the outside of circular chart 886 being the most recent time and the center point being the oldest time) may be used to indicate the energy or progress (e.g., via color or patterning such as dashes or dots rather than a solid line).

In user interface 850, circular chart 886 may also be color coded, with the color coding existing in a band 890 around circular chart 886 or positioned or represented in other ways. The color coding may use colors to indicate activity in a certain direction. For example, the color red may indicate the highest level of activity, while the color blue may indicate the lowest level of activity. Furthermore, the arc range in degrees of a color may indicate the amount of deviation. Accordingly, a relatively narrow (e.g., thirty degrees) arc of red with a relatively broad (e.g., three hundred degrees) arc of blue may indicate that most activity is occurring in a particular tool face orientation with little deviation. As shown in user interface 850, the color blue may extend from approximately 22-337 degrees, the color green may extend from approximately 15-22 degrees and 337-345 degrees, the color yellow may extend a few degrees around the 13- and 345-degree marks, while the color red may extend from approximately 347-10 degrees. Transition colors or shades may be used with, for example, the color orange marking the transition between red and yellow or a light blue marking the transition between blue and green. This color coding may enable user interface 850 to provide an intuitive summary of how narrow the standard deviation is and how much of the energy intensity is being expended in the proper direction. Furthermore, the center of energy may be viewed relative to the target. For example, user interface 850 may clearly show that the target is at 90 degrees, but the center of energy is at 45 degrees.

In user interface 850, other indicators, such as a slide indicator 892, may indicate how much time remains until a slide occurs or how much time remains for a current slide. For example, slide indicator 892 may represent a time, a percentage (e.g., as shown, a current slide may be 56% complete), a distance completed, or a distance remaining. Slide indicator 892 may graphically display information using, for example, a colored bar 893 that increases or decreases with slide progress. In some embodiments, slide indicator 892 may be built into circular chart 886 (e.g., around the outer edge with an increasing/decreasing band), while in other embodiments slide indicator 892 may be a separate indicator such as a meter, a bar, a gauge, or another indicator type. In various implementations, slide indicator 892 may be refreshed by autoslide 514.

In user interface 850, an error indicator 894 may indicate a magnitude and a direction of error. For example, error indicator 894 may indicate that an estimated drill bit position is a certain distance from the planned trajectory, with a location of error indicator 894 around the circular chart 886 representing the heading. For example, FIG. 8 illustrates an error magnitude of 15 feet and an error direction of 15 degrees. Error indicator 894 may be any color but may be red for purposes of example. It is noted that error indicator 894 may present a zero if there is no error. Error indicator may represent that drill bit 148 is on the planned trajectory using other means, such as being a green color. Transition colors, such as yellow, may be used to indicate varying amounts of error. In some embodiments, error indicator 894 may not appear unless there is an error in magnitude or direction. A marker 896 may indicate an ideal slide direction. Although not shown, other indicators may be present, such as a bit life indicator to indicate an estimated lifetime for the current bit based on a value such as time or distance.

It is noted that user interface 850 may be arranged in many different ways. For example, colors may be used to indicate normal operation, warnings, and problems. In such cases, the numerical indicators may display numbers in one color (e.g., green) for normal operation, may use another color (e.g., yellow) for warnings, and may use yet another color (e.g., red) when a serious problem occurs. The indicators may also flash or otherwise indicate an alert. The gauge indicators may include colors (e.g., green, yellow, and red) to indicate operational conditions and may also indicate the target value (e.g., an ROP of 100 feet/hour). For example, ROP indicator 868 may have a green bar to indicate a normal level of operation (e.g., from 10-300 feet/hour), a yellow bar to indicate a warning level of operation (e.g., from 300-360 feet/hour), and a red bar to indicate a dangerous or otherwise out of parameter level of operation (e.g., from 360-390 feet/hour). ROP indicator 868 may also display a marker at 100 feet/hour to indicate the desired target ROP.

Furthermore, the use of numeric indicators, gauges, and similar visual display indicators may be varied based on factors such as the information to be conveyed and the personal preference of the viewer. Accordingly, user interface 850 may provide a customizable view of various drilling processes and information for a particular individual involved in the drilling process. For example, steering control system 168 may enable a user to customize the user interface 850 as desired, although certain features (e.g., standpipe pressure) may be locked to prevent a user from intentionally or accidentally removing important drilling information from user interface 850. Other features and attributes of user interface 850 may be set by user preference. Accordingly, the level of customization and the information shown by the user interface 850 may be controlled based on who is viewing user interface 850 and their role in the drilling process.

Figure 9:
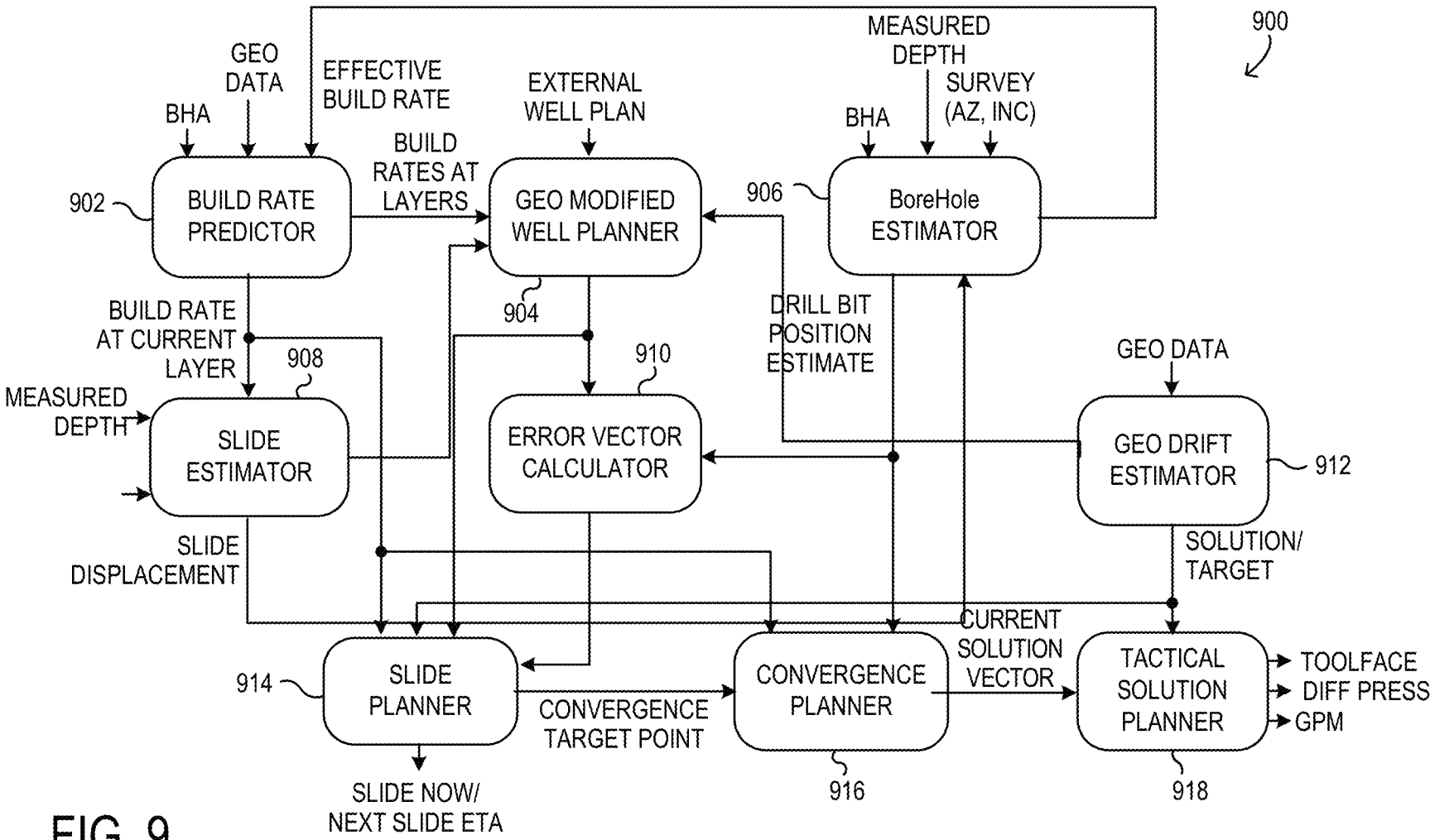
FIG. 9 is a depiction of a guidance control loop performed by the rig control systems.

Referring to FIG. 9, one embodiment of a guidance control loop (GCL) 900 is shown in further detail GCL 900 may represent one example of a control loop or control algorithm executed under the control of steering control system 168. GCL 900 may include various functional modules, including a build rate predictor 902, a geo modified well planner 904, a borehole estimator 906, a slide estimator 908, an error vector calculator 910, a geological drift estimator 912, a slide planner 914, a convergence planner 916, and a tactical solution planner 918. In the following description of GCL 900, the term "external input" refers to input received from outside GCL 900, while "internal input" refers to input exchanged between functional modules of GCL 900.

In FIG. 9, build rate predictor 902 receives external input representing BHA information and geological information, receives internal input from the borehole estimator 906, and provides output to geo modified well planner 904, slide estimator 908, slide planner 914, and convergence planner 916. Build rate predictor 902 is configured to use the BHA information and geological information to predict drilling build rates of current and future sections of borehole 106. For example, build rate predictor 902 may determine how aggressively a curve will be built for a given formation with BHA 149 and other equipment parameters.

In FIG. 9, build rate predictor 902 may use the orientation of BHA 149 to the formation to determine an angle of attack for formation transitions and build rates within a single layer of a formation. For example, if a strata layer of rock is below a strata layer of sand, a formation transition exists between the strata layer of sand and the strata layer of rock. Approaching the strata layer of rock at a 90-degree angle may provide a good tool face and a clean drill entry, while approaching the rock layer at a 45-degree angle may build a curve relatively quickly. An angle of approach that is near parallel may cause drill bit 148 to skip off the upper surface of the strata layer of rock. Accordingly, build rate predictor 902 may calculate BHA orientation to account for formation transitions. Within a single strata layer, build rate predictor 902 may use the BHA orientation to account for internal layer characteristics (e.g., grain) to determine build rates for different parts of a strata layer. The BHA information may include bit characteristics, mud motor bend setting, stabilization, and mud motor bit to bend distance. The geological information may include formation data such as compressive strength, thicknesses, and depths for formations encountered in the specific drilling location. Such information may enable a calculation-based prediction of the build rates and ROP that may be compared to both results obtained while drilling borehole 106 and regional historical results (e.g., from the regional drilling DB 412) to improve the accuracy of predictions as drilling progresses. Build rate predictor 902 may also be used to plan convergence adjustments and confirm in advance of drilling that targets can be achieved with current parameters.

In FIG. 9, geo modified well planner 904 receives external input representing a well plan, internal input from build rate predictor 902 and geo drift estimator 912 and provides output to slide planner 914 and error vector calculator 910. Geo modified well planner 904 uses the input to determine whether there is a more desirable trajectory than that provided by the well plan, while staying within specified error limits. More specifically, geo modified well planner 904 takes geological information (e.g., drift) and calculates whether another trajectory solution to the target may be more efficient in terms of cost or reliability. The outputs of geo modified well planner 904 to slide planner 914 and error vector calculator 910 may be used to calculate an error vector based on the current vector to the newly calculated trajectory and to modify slide predictions. In some embodiments, geo modified well planner 904 (or another module) may provide functionality needed to track a formation trend. For example, in horizontal wells, a geologist may provide steering control system 168 with a target inclination angle as a set point for steering control system 168 to control. For example, the geologist may enter a target to steering control system 168 of 90.5-91.0 degrees of inclination angle for a section of borehole 106. Geo modified well planner 904 may then treat the target as a vector target, while remaining within the error limits of the original well plan. In some embodiments, geo modified well planner 904 may be an optional module that is not used unless the well plan is to be modified. For example, if the well plan is marked in steering control system 168 as non-modifiable, geo modified well planner 904 may be bypassed altogether or geo modified well planner 904 may be configured to pass the well plan through without any changes.

In FIG. 9, borehole estimator 906 may receive external inputs representing BHA information, measured depth information, survey information (e.g., azimuth angle and inclination angle), and may provide outputs to build rate predictor 902, error vector calculator 910, and convergence planner 916. Borehole estimator 906 may be configured to provide an estimate of the actual borehole and drill bit position and trajectory angle without delay, based on either straight-line projections or projections that incorporate sliding. Borehole estimator 906 may be used to compensate for a sensor being physically located some distance behind drill bit 148 (e.g., 50 feet) in drill string 146, which makes sensor readings lag the actual bit location by 50 feet. Borehole estimator 906 may also be used to compensate for sensor measurements that may not be continuous (e.g., a sensor measurement may occur every 100 feet). Borehole estimator 906 may provide the most accurate estimate from the surface to the last survey location based on the collection of survey measurements. Also, borehole estimator 906 may take the slide estimate from slide estimator 908 (described below) and extend the slide estimate from the last survey point to a current location of drill bit 148. Using the combination of these two estimates, borehole estimator 906 may provide steering control system 168 with an estimate of the drill bit's location and trajectory angle from which guidance and steering solutions can be derived. An additional metric that can be derived from the borehole estimate is the effective build rate that is achieved throughout the drilling process.

In FIG. 9, slide estimator 908 receives external inputs representing measured depth and differential pressure information, receives internal input from build rate predictor 902, and provides output to borehole estimator 906 and geo modified well planner 904. Slide estimator 908 may be configured to sample tool face orientation, differential pressure, measured depth (MD) incremental movement, MSE, and other sensor feedback to quantify/estimate a deviation vector and progress while sliding.

Traditionally, deviation from the slide would be predicted by a human operator based on experience. The operator would, for example, use a long slide cycle to assess what likely was accomplished during the last slide. However, the results are generally not confirmed until the downhole survey sensor point passes the slide portion of the borehole, often resulting in a response lag defined by a distance of the sensor point from the drill bit tip (e.g., approximately 50 feet). Such a response lag may introduce inefficiencies in the slide cycles due to over/under correction of the actual trajectory relative to the planned trajectory.

In GCL 900, using slide estimator 908, each tool face update may be algorithmically merged with the average differential pressure of the period between the previous and current tool face readings, as well as the MD change during this period to predict the direction, angular deviation, and MD progress during the period. As an example, the periodic rate may be between 10 and 60 seconds per cycle depending on the tool face update rate of downhole tool 166. With a more accurate estimation of the slide effectiveness, the sliding efficiency can be improved. The output of slide estimator 908 may accordingly be periodically provided to borehole estimator 906 for accumulation of well deviation information, as well to geo modified well planner 904. Some or all of the output of the slide estimator 908 may be output to an operator, such as shown in the user interface 850 of FIG. 8.

In FIG. 9, error vector calculator 910 may receive internal input from geo modified well planner 904 and borehole estimator 906. Error vector calculator 910 may be configured to compare the planned well trajectory to an actual borehole trajectory and drill bit position estimate. Error vector calculator 910 may provide the metrics used to determine the error (e.g., how far off) the current drill bit position and trajectory are from the well plan. For example, error vector calculator 910 may calculate the error between the current bit position and trajectory to the planned trajectory and the desired bit position. Error vector calculator 910 may also calculate a projected bit position/projected trajectory representing the future result of a current error.

In FIG. 9, geological drift estimator 912 receives external input representing geological information and provides outputs to geo modified well planner 904, slide planner 914, and tactical solution planner 918. During drilling, drift may occur as the particular characteristics of the formation affect the drilling direction. More specifically, there may be a trajectory bias that is contributed by the formation as a function of ROP and BHA 149. Geological drift estimator 912 is configured to provide a drift estimate as a vector that can then be used to calculate drift compensation parameters that can be used to offset the drift in a control solution.

In FIG. 9, slide planner 914 receives internal input from build rate predictor 902, geo modified well planner 904, error vector calculator 910, and geological drift estimator 912, and provides output to convergence planner 916 as well as an estimated time to the next slide. Slide planner 914 may be configured to evaluate a slide/drill ahead cost calculation and plan for sliding activity, which may include factoring in BHA wear, expected build rates of current and expected formations, and the well plan trajectory. During drill ahead, slide planner 914 may attempt to forecast an estimated time of the next slide to aid with planning. For example, if additional lubricants (e.g., fluorinated beads) are indicated for the next slide, and pumping the lubricants into drill string 146 has a lead time of 30 minutes before the slide, the estimated time of the next slide may be calculated and then used to schedule when to start pumping the lubricants. Functionality for a loss circulation material (LCM) planner may be provided as part of slide planner 914 or elsewhere (e.g., as a stand-alone module or as part of another module described herein). The LCM planner functionality may be configured to determine whether additives should be pumped into the borehole based on indications such as flow-in versus flow-back measurements. For example, if drilling through a porous rock formation, fluid being pumped into the borehole may get lost in the rock formation. To address this issue, the LCM planner may control pumping LCM into the borehole to clog up the holes in the porous rock surrounding the borehole to establish a more closed-loop control system for the fluid.

In FIG. 9, slide planner 914 may also look at the current position relative to the next connection. A connection may happen every 90 to 100 feet (or some other distance or distance range based on the particulars of the drilling operation) and slide planner 914 may avoid planning a slide when close to a connection or when the slide would carry through the connection. For example, if the slide planner 914 is planning a 50-foot slide but only 20 feet remain until the next connection, slide planner 914 may calculate the slide starting after the next connection and make any changes to the slide parameters to accommodate waiting to slide until after the next connection. Such flexible implementation avoids inefficiencies that may be caused by starting the slide, stopping for the connection, and then having to reorient the tool face before finishing the slide. During slides, slide planner 914 may provide some feedback as to the progress of achieving the desired goal of the current slide. In some embodiments, slide planner 914 may account for reactive torque in drill string 146. More specifically, when rotating is occurring, there is a reactional torque wind up in drill string 146. When the rotating is stopped, drill string 146 unwinds, which changes tool face orientation and other parameters. When rotating is started again, drill string 146 starts to wind back up. Slide planner 914 may account for the reactional torque so that tool face references are maintained, rather than stopping rotation and then trying to adjust to a desired tool face orientation. While not all downhole tools may provide tool face orientation when rotating, using one that does supply such information for GCL 900 may significantly reduce the transition time from rotating to sliding.

In FIG. 9, convergence planner 916 receives internal inputs from build rate predictor 902, borehole estimator 906, and slide planner 914, and provides output to tactical solution planner 918. Convergence planner 916 is configured to provide a convergence plan when the current drill bit position is not within a defined margin of error of the planned well trajectory. The convergence plan represents a path from the current drill bit position to an achievable and desired convergence target point along the planned trajectory. The convergence plan may take account the amount of sliding/drilling ahead that has been planned to take place by slide planner 914. Convergence planner 916 may also use BHA orientation information for angle of attack calculations when determining convergence plans as described above with respect to build rate predictor 902. The solution provided by convergence planner 916 defines a new trajectory solution for the current position of drill bit 148. The solution may be immediate without delay, or planned for implementation at a future time that is specified in advance.

In FIG. 9, tactical solution planner 918 receives internal inputs from geological drift estimator 912 and convergence planner 916 and provides external outputs representing information such as tool face orientation, differential pressure, and mud flow rate. Tactical solution planner 918 is configured to take the trajectory solution provided by convergence planner 916 and translate the solution into control parameters that can be used to control drilling rig 210. For example, tactical solution planner 918 may convert the solution into settings for control systems 522, 524, and 526 to accomplish the actual drilling based on the solution. Tactical solution planner 918 may also perform performance optimization to optimizing the overall drilling operation as well as optimizing the drilling itself (e.g., how to drill faster).

Other functionality may be provided by GCL 900 in additional modules or added to an existing module. For example, there is a relationship between the rotational position of the drill pipe on the surface and the orientation of the downhole tool face. Accordingly, GCL 900 may receive information corresponding to the rotational position of the drill pipe on the surface. GCL 900 may use this surface positional information to calculate current and desired tool face orientations. These calculations may then be used to define control parameters for adjusting the top drive 140 to accomplish adjustments to the downhole tool face in order to steer the trajectory of borehole 106.

For purposes of example, an object-oriented software approach may be utilized to provide a class-based structure that may be used with GCL 900, or other functionality provided by steering control system 168. In GCL 900, a drilling model class may be defined to capture and define the drilling state throughout the drilling process. The drilling model class may include information obtained without delay. The drilling model class may be based on the following components and sub-models: a drill bit model, a borehole model, a rig surface gear model, a mud pump model, a WOB/differential pressure model, a positional/rotary model, an MSE model, an active well plan, and control limits. The drilling model class may produce a control output solution and may be executed via a main processing loop that rotates through the various modules of GCL 900. The drill bit model may represent the current position and state of drill bit 148. The drill bit model may include a three-dimensional (3D) position, a drill bit trajectory, BHA information, bit speed, and tool face (e.g., orientation information). The 3D position may be specified in north-south (NS), east-west (EW), and true vertical depth (TVD). The drill bit trajectory may be specified as an inclination angle and an azimuth angle. The BHA information may be a set of dimensions defining the active BHA. The borehole model may represent the current path and size of the active borehole. The borehole model may include hole depth information, an array of survey points collected along the borehole path, a gamma log, and borehole diameters. The hole depth information is for current drilling of borehole 106. The borehole diameters may represent the diameters of borehole 106 as drilled over current drilling. The rig surface gear model may represent pipe length, block height, and other models, such as the mud pump model, WOB/differential pressure model, positional/rotary model, and MSE model. The mud pump model represents mud pump equipment and includes flow rate, standpipe pressure, and differential pressure. The WOB/differential pressure model represents draw works or other WOB/differential pressure controls and parameters, including WOB. The positional/rotary model represents top drive or other positional/rotary controls and parameters including rotary RPM and spindle position. The active well plan represents the target borehole path and may include an external well plan and a modified well plan. The control limits represent defined parameters that may be set as maximums and/or minimums. For example, control limits may be set for the rotary RPM in the top drive model to limit the maximum rotations per minute (RPMs) to the defined level. The control output solution may represent the control parameters for drilling rig 210.

Each functional module of GCL 900 may have behavior encapsulated within a respective class definition. During a processing window, the individual functional modules may have an exclusive portion in time to execute and update the drilling model. For purposes of example, the processing order for the functional modules may be in the sequence of geo modified well planner 904, build rate predictor 902, slide estimator 908, borehole estimator 906, error vector calculator 910, slide planner 914, convergence planner 916, geological drift estimator 912, and tactical solution planner 918. It is noted that other sequences may be used in different implementations.

In FIG. 9, GCL 900 may rely on a programmable timer module that provides a timing mechanism to provide timer event signals to drive the main processing loop. While steering control system 168 may rely on timer and date calls driven by the programming environment, timing may be obtained from other sources than system time. In situations where it may be advantageous to manipulate the clock (e.g., for evaluation and testing), a programmable timer module may be used to alter the system time. For example, the programmable timer module may enable a default time set to the system time and a time scale of 1.0, may enable the system time of steering control system 168 to be manually set, may enable the time scale relative to the system time to be modified, or may enable periodic event time requests scaled to a requested time scale.

Referring now to FIG. 10, a block diagram illustrating selected elements of an embodiment of a controller 1000 for performing surface steering according to the present disclosure. In various embodiments, controller 1000 may represent an implementation of steering control system 168. In other embodiments, at least certain portions of controller 1000 may be used for control systems 510, 512, 514, 522, 524, and 526 (see FIG. 5).

In the embodiment depicted in FIG. 10, controller 1000 includes processor 1001 coupled via shared bus 1002 to storage media collectively identified as memory media 1010.

Controller 1000, as depicted in FIG. 10, further includes network adapter 1020 that interfaces controller 1000 to a network (not shown in FIG. 10). In embodiments suitable for use with user interfaces, controller 1000, as depicted in FIG. 10, may include peripheral adapter 1006, which provides connectivity for the use of input device 1008 and output device 1009. Input device 1008 may represent a device for user input, such as a keyboard or a mouse, or even a video camera. Output device 1009 may represent a device for providing signals or indications to a user, such as loudspeakers for generating audio signals.

Controller 1000 is shown in FIG. 10 including display adapter 1004 and further includes a display device 1005. Display adapter 1004 may interface shared bus 1002, or another bus, with an output port for one or more display devices, such as display device 1005. Display device 1005 may be implemented as a liquid crystal display screen, a computer monitor, a television, or the like. Display device 1005 may comply with a display standard for the corresponding type of display. Standards for computer monitors include analog standards such as video graphics array (VGA), extended graphics array (XGA), etc., or digital standards such as digital visual interface (DVI), definition multimedia interface (HDMI), among others. A television display may comply with standards such as NTSC (National Television System Committee), PAL (Phase Alternating Line), or another suitable standard. Display device 1005 may include an output device 1009, such as one or more integrated speakers to play audio content, or may include an input device 1008, such as a microphone or video camera.

In FIG. 10, memory media 1010 encompasses persistent and volatile media, fixed and removable media, and magnetic and semiconductor media. Memory media 1010 is operable to store instructions, data, or both. Memory media 1010 as shown includes sets or sequences of instructions 1024-2, namely, an operating system 1012 and surface steering control 1014. Operating system 1012 may be a UNIX or UNIX-like operating system, a Windows® family operating system, or another suitable operating system. Instructions 1024 may also reside, completely or at least partially, within processor 1001 during execution thereof. It is further noted that processor 1001 may be configured to receive instructions 1024-1 from instructions 1024-2 via shared bus 1002. In some embodiments, memory media 1010 is configured to store and provide executable instructions for executing GCL 900, as mentioned previously, among other methods and operations disclosed herein.

The following disclosure explains additional and improved methods and systems for drilling. In particular, the following systems and methods can be useful to drill deeper wells, especially through harder rock formations, faster and more efficiently than with conventional drilling techniques. It should be noted that the following methods may be implemented by a computer system such as any of those described above. For example, the computer system used to monitor, perform and/or control the methods described below may be a part of the steering control system 168, a part of the rig controls system 500, a part of the drilling system 100, included with the controller 1000, or may be a similar or different computer system and may be coupled to one or more of the foregoing systems. The computer system may be located at or near the rig site or may be located at a remote location from the rig site and may be configured to transmit and receive data to and from a rig site while a well is being drilled. Moreover, it should be noted that the computer system and/or the control system for controlling the flow of fuel and/or drilling mud may be located downhole in some situations.

Improved Drilling Operations Using High Pressure Mud Pump

A mud pump (e.g. a mud pump, such as mud pump unit 152) is a piece of equipment used in drilling operations, specifically in the oil and gas industry. It plays a vital role in circulating drilling fluid, commonly known as drilling mud, during the drilling process. The primary function of a mud pump is to generate sufficient hydraulic pressure to transport the drilling mud from the surface down to a bottom of a wellbore and back to the surface.

Many mud pumps used in drilling operations are of the triplex design, meaning they have three pistons or plungers. These pistons work in a reciprocating motion, synchronized by a crankshaft, to create a continuous flow of mud. As one piston retracts, it creates a low-pressure area that draws mud into the cylinder, while the other two pistons push mud out under high pressure.

The mud pump pressurizes the drilling mud, forcing it to flow through the high-pressure lines and into the drill string. The mud then travels down the drill string, exits through the bit, and returns to the surface through the annulus—the space between the drill string and the wellbore walls.

Mud pumps that are positive displacement piston pumps can have short service life. For example, drilling mud can cause wear on the inside of pistons of positive displacement piston pumps in which there is contact between the drilling mud and the piston due to several factors. Drilling mud often contains solid particles such as rock cuttings, sand, and other abrasive materials. As the mud is circulated through the positive displacement piston pumps, these particles can become entrained in the fluid and act as abrasive agents. As the high-pressure mud passes through the piston chamber, a small amount of drilling mud slips past the piston—between the piston seal and the cylinder bore at high pressure—and escapes the chamber thereby affecting erosion and wear. This continual erosion caused by the escaping mud contributes to accelerating additional erosion between the piston and cylinder bore; which consequently leads to a seal failure commonly referred to as a piston or liner "wash."

Mud pumps generate high hydraulic pressure to propel the drilling mud through the system. The high-pressure flow combined with the reciprocating motion of the pistons creates a turbulent environment inside the pump. In positive displacement piston pumps this turbulence, coupled with the velocity of the mud, can cause erosion and wear between the piston outer diameter and the cylinder bore, especially at high-velocity areas such as the piston head and seals. The most common mode of failure—for conventional tri-plex and quintu-plex pumps—is between the outer diameter of the piston (or "swab") and the bore of the cylinder ("liner"). When the integrity of that seal is progressively lost, this initiates a very small gap through which the mud is pushed past the piston at an exceptionally high velocity and pressure and carves "channels" into both the piston and cylinder. Once such "channels" exist, the pump effectively loses pressure. At this point, this area of the pump needs to be disassembled and the parts replaced so that the restored pump can be used again. This mode of failure can be a regular cause for downtime on positive displacement piston pumps.

Drilling mud often contains various chemical additives to enhance its properties. These additives can react with the materials used in the construction of the pistons of positive displacement piston pumps, causing corrosion and accelerated wear. The chemical composition and pH of the mud, as well as the temperature, can influence the severity of these reactions.

Cavitation is a phenomenon that occurs when the pressure of a fluid drops rapidly, leading to the formation and collapse of vapor bubbles. In mud pumps, cavitation can occur when the pressure drops rapidly on the suction side of the piston during the retraction stroke. The collapsing vapor bubbles can cause localized pressure spikes and result in erosion and pitting on the piston surface. Cavitation depends partly on the property of the fluid used. Thus, in some embodiments, the effects of cavitation are reduced depending on the first fluid used.

Lubrication is crucial to reduce friction and wear between the piston and cylinder walls. Drilling mud serves as a lubricant for the piston seals and the piston-cylinder interface of positive displacement piston pumps. However, if the mud properties are not adequately maintained or if there are interruptions in the mud flow, the lubrication may become insufficient. Insufficient lubrication can lead to increased friction and wear between the piston and cylinder surfaces. In typical drilling operations, downtime can be managed by either replacing the cylinders (also known as the "liners") and pistons of positive displacement piston pumps as a preventative measure before drilling a section of the well or waiting until failure of the cylinder. There can be advantages to catching a piston or cylinder before they wash completely—such as doing preventative replacement if wear is noticed before the high pressure "lateral" portion of the well program. In most cases, as far as it concerns the future service life of those two components, there is no real difference between a piston/cylinder which is "almost washed" or "completely washed." Under either condition the piston/cylinder may not be usable again. Therefore, regular inspection can be used to proactively schedule the downtime, but it does not extend the service life of the piston or cylinder of positive displacement piston pumps. By contrast, as it pertains to valve poppets and valve seats, regular inspection and monitoring of the valve poppet and seat can extend the service life of the main fluid end block. If the valve poppet is found to be losing pressure due to erosion—which means it is "washing"—then if that "wash" is caught early, then the damage can be mitigated to only the valve poppet or seat, and consequently spare the more expensive fluid end from also sustaining erosion, thereby extending its service life.

To mitigate wear caused by drilling mud, regular inspection of mud pump pistons can help identify signs of wear and damage. Timely replacement of worn pistons or piston components can prevent further damage and ensure the pump operates efficiently. However, such replacement action still requires downtime on the drilling rig which can increase costs associated with drilling the borehole.

According to aspects of the present disclosure, the mud pump may include a piston-diaphragm pump. A piston-diaphragm pump combines the conventional reciprocating action of a piston with the function of a flexible diaphragm. The flexible diaphragm separates the piston from the drilling mud and thereby separates abrasive mediums from machine parts. The piston-diaphragm pump design offers several advantages in terms of reliability, performance, and versatility for handling drilling mud.

A piston-diaphragm pump used as a mud pump according to aspects of the present disclosure may consist of a piston assembly that moves back and forth within a cylinder. The reciprocating motion of the piston creates suction and discharge strokes, enabling the transfer of drilling mud, similar in operation to a conventional positive displacement triplex pump. This design allows for high-pressure generation and efficient pumping action.

The piston-diaphragm pump can also include a flexible diaphragm that separates the piston chamber from the hydraulic fluid chamber. This diaphragm serves as a seal to prevent direct contact between the drilling mud and the piston. The diaphragm thereby acts as a barrier, protecting the piston from abrasive solids and corrosive fluids while maintaining the hydraulic pressure required for pumping.

The piston-diaphragm pump can also include a diaphragm specifically designed to handle the properties of drilling mud, including its density, viscosity, and chemical composition. The diaphragm may be constructed from durable and wear-resistant materials that can withstand the abrasive nature of the mud and resist corrosion from chemical additives.

The particular advantage of the diaphragm of a piston-diaphragm pump according to embodiments of the present disclosure is that it isolates the abrasive drilling mud and does not allow it to touch the piston, thereby dramatically extending the service life of the piston & cylinder bore. The application of additional horsepower is a factor in higher operating pressures up to 10,000 psi, which would also positively affect stability, rate of penetration, and bore cleaning of the drilling operations using such a mud pump. Although the diaphragm alone does not cause the higher pressures, the diaphragm's primary function is to isolate the drilling mud from the piston at any pressure.

Piston-diaphragm pumps according to embodiments of the present disclosure can handle a wide range of mud types, including both water-based and oil-based muds. They can accommodate different mud viscosities, densities, and chemical compositions. This versatility makes them suitable for various drilling applications and allows for adjustments based on specific drilling requirements.

Piston-diaphragm pumps according to embodiments of the present disclosure also offer reliable performance and durability, minimizing downtime during drilling operations. The diaphragm acts to protect the piston and other pump internals from wear and damage. The service life of the diaphragm can be measured in years, whereas the service life of the piston and cylinder in a conventional mud pump including positive displacement pumps where the mud is in contact with the piston is usually measured in hours. When the diaphragm eventually wears out, it can be easily replaced, ensuring predictable maintenance and reliable pump operation.

A piston-diaphragm pump used as a mud pump according to embodiments of the present disclosure combines the reciprocating motion of a positive displacement pump with the 'medium isolation' of a diaphragm pump. It provides high-pressure pumping for efficient mud circulation, while the diaphragm protects the pump internals from wear and damage. This design offers versatility, reliability, and adaptability, making it a suitable choice for handling drilling mud in various drilling applications. In various embodiments, a two-motor arrangement can power a 2,000-horsepower pump capable of 10,000 psi and 330 gpm. In various embodiments, lower pressure (e.g., 7500 psi) piston-diaphragm pumps may be used.

During different drilling operations the pistons may be changed to a different size. For example, when drilling straight down at the beginning of the well, a goal is to achieve a high flow rate and pressure is secondary. But, when the drilling changes to lateral, a much smaller piston may be used to achieve a higher pressure because of the water table and the substrate, and the driller does not want the hole to cave in. Therefore, a higher pressure may be required in the lateral. So, with a higher pressure piston-diaphragm pump the piston size may not need to be changed to achieve the higher pressure in the lateral.

The piston-diaphragm pump can reduce the downtime of the pumps because the swab and liner will now not need to be routinely replaced. This will also reduce the cost of drilling because spare swabs and liners will no longer need to be purchased routinely for replacements, as in the past.

Using a piston-diaphragm pump in a mud pump according to embodiments of the present disclosure can provide for a higher pressure mud pump, as described above. The ability to use a higher pressure mud pump can have several impacts on the drilling process. First, a higher-pressure mud pump can result in increased rate of penetration (ROP). Higher pressure from the mud pump translates to increased hydraulic force on the drill bit. This increased force helps to enhance the rate of penetration, allowing the bit to cut through the formation more efficiently. The higher pressure enables the bit to break and remove rock more effectively, leading to faster drilling progress.

Higher differential pressure can improve the quality of formation evaluation while drilling. By maintaining a higher-pressure differential, the drilling mud can prevent fluid invasion from the formation into the wellbore. This allows for more accurate measurements and sampling of the formation, enhancing the understanding of reservoir properties and hydrocarbon potential.

A higher pressure can reduce the number of pumps being used at a drill site. For example, in some rigs, three pumps are normally used for the mud pumping operations. The three pumps are run simultaneously to reduce wear and tear due to higher loads on the pumps. A mud pump with a high rated pressure can be used at lower pressures further reducing both the number of pumps and the power the pumps are operating at.

Higher differential pressures can result in cleaner signals for telemetry. By increasing the differential pressure, the signal to noise ratio in the telemetry signals can be improved. This can result in more accurate tool face detection and other BHA signals at the surface.

A higher pressure mud pump can improve hole cleaning. The higher pressure from the mud pump aids in better hole cleaning. As the mud is forced through the drill bit and up the annulus, it carries the rock cuttings and debris to the surface more effectively. The increased pressure helps to flush out the cuttings, preventing them from settling in the wellbore and impeding drilling operations.

A higher pressure mud pump can result in enhanced wellbore stability. High-pressure mud circulation is crucial for maintaining wellbore stability. The pressure exerted by the mud helps to balance the formation pressure, preventing blowouts or formation fluid influx. It also forms a mud cake on the wellbore walls, which provides a protective barrier and helps prevent wellbore collapse or formation damage.

A higher pressure mud pump can improve hole integrity. The higher pressure generated by the mud pump contributes to the creation of a more robust and stable wellbore. It helps to prevent wellbore instability issues such as sloughing, caving, or differential sticking. The increased pressure can also aid in controlling the influx of formation fluids, mitigating the risk of well control incidents.

A higher pressure mud pump can increase drilling fluid properties control. Mud pumps play a crucial role in maintaining the desired properties of the drilling fluid. Higher pressure allows for better control over mud density, viscosity, and filtration properties. It enables effective mixing of additives and chemicals, ensuring that the mud properties are optimized for efficient drilling and well control.

A higher pressure mud pump can achieve extended reach capabilities: In directional or extended reach drilling operations, where the wellbore trajectory deviates from vertical, higher pressure mud pumps are often required. The increased pressure helps to overcome the frictional losses encountered while drilling horizontally or at high angles. It allows the drilling fluid to effectively reach and clean the entire length of the wellbore.

Figure 11:
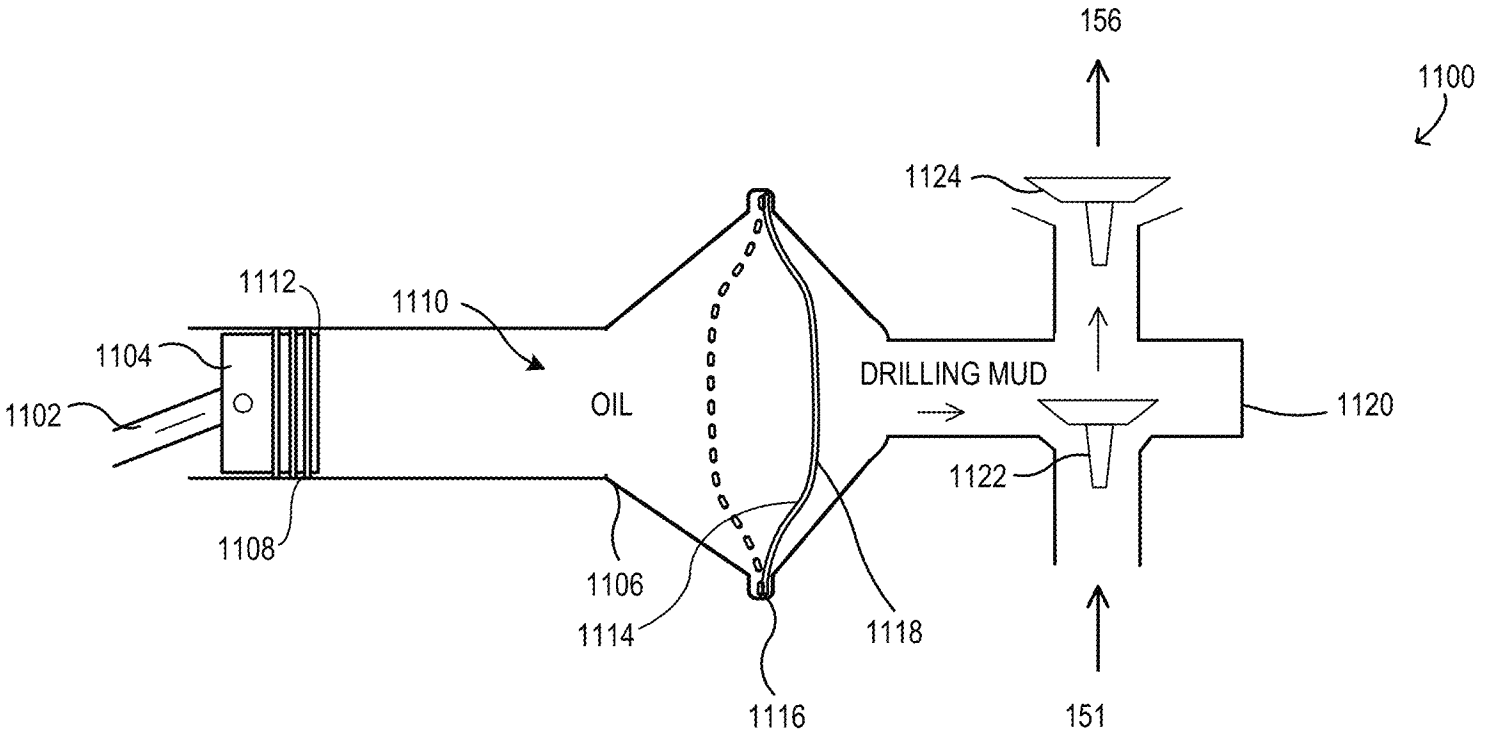
FIG. 11 illustrates an exemplary embodiment of a piston diaphragm pump used as a drilling mud pump, in accordance with some embodiments.

FIG. 11 illustrates a non-limiting embodiments of an improved mud pump 1100 using a piston-diaphragm pump. The improved mud pump 1100 can include a motor (not shown) connected via an arm 1102 to a piston 1104 inside a cylinder 1106. The piston 1104 is sized to travel inside the cylinder 1106. The piston 1104 can include one or more seals 1108 to prevent leakage of a first fluid (e.g. oil) contained within a first chamber 1110. The first chamber 1110 can contain the first fluid between a head 1112 of the piston 1104 and a first side 1114 of a diaphragm 1116 inside the cylinder 1106. The piston 1104 can apply a force to the first fluid which is then applied to the first side 1114 of the diaphragm 1116.

The improved mud pump 1100 can include a second chamber 1120 containing a second fluid (e.g. drilling fluid, drilling mud) between a second side 1118 of the diaphragm. In various embodiments, the second chamber 1120 can have a low-pressure check valve 1122 and a high-pressure check valve 1124. Movement of the piston 1104 causes a flowrate of the second fluid from the second chamber 1120 through the high-pressure check valve 1124 to a borehole via piping (not shown in FIG. 11). In various embodiments, the diaphragm 1116 flexes to a concave shape (shown in dashed) at a bottom of a stroke of the piston 1104 and the diaphragm flexes to a convex shape at the top of the stroke of the piston 1104. In various embodiments, the first fluid is a lubricating oil. In various embodiments, the second fluid is a drilling fluid, such as drilling mud. Advantageously, this pump design allows the drilling fluid to be pumped at high pressure and flowrate without the drilling fluid contacting the piston and cylinder, thereby avoiding degradation of the piston and liner as described above. In various embodiments, the pump generates a pressure within a range between 7,000 psi and 8,000 psi. In various embodiments, the pump generates a flowrate in a range between 320 and 380 gpm, such as about 330 gpm. In various embodiments, the pump is operated by a motor of 1,000 horsepower (HP) or greater, such as 1,000 HP or 2,000 HP. In various embodiments, the pump provides both a high pressure, such as greater than 7,000 PSI, and a high flowrate, such as greater than 300 gpm.

The low-pressure check value 1122 can open during an intake stroke of the piston 1104. During the intake stroke, the piston 1104 moves within the cylinder 1106, in a direction away from the diaphragm 1116. This motion creates a lower pressure zone within the cylinder 1106, allowing a relatively higher-pressure drilling mud to flow through the low-pressure check valve 1122 from the mud pits of storage tanks via pipes. A 'charge pump' takes the mud from the tank and increases its pressure from atmosphere to around 50 psi or 75 psi. When the piston 1104 moves away from the diaphragm (causing the diaphragm to flex backward), the pressure from the charge pump opens up the lower check valve and fills the chamber between the 2nd side of the diaphragm 1118 and the valves 1122 and 1124. The intake stroke prepares the cylinder 1106 for the subsequent power stroke.

During a power stroke, the low-pressure check valve 1122 closes and the high-pressure valve 1124 opens sending the drilling mud through the high-pressure valve 1124 to the borehole via pipes.

The mud pump 1100 can be used within a drilling mud unit 154 in a drilling setup as shown in FIG. 1. In such embodiments, the pump unit is fed drilling fluid via input line 151 and discharges the drilling fluid via discharge line 158 at a specified high flowrate and pressure to facilitate drilling. In some embodiments, the drilling mud unit 154 can include multiple such mud pumps operating concurrently, such as shown in FIG. 12. Further, a drilling mud unit can include multiple mud pumps run in parallel.

The mud pump system may include a Variable Frequency Drive (VFD) (not shown). The VFD can be a device used to control the speed and power output of an electric motor driving the pump when used as a mud pump in drilling and industrial applications. In various embodiments, the electric motor can be an AC motor or a DC motor. In various embodiments, the number of modules in the VFD can be increased to accommodate the increased current capacity.

The mud pump is typically powered by an electric motor. The speed of this motor determines the flow rate and pressure of the mud being pumped. A standard motor would run at a fixed speed determined by the frequency of the electrical supply (e.g., 60 Hz in the United States). However, a VFD can vary the frequency and voltage supplied to the motor. Advantageously, the VFD allows for adjustment of the pump to provide variation of high pressure and/or high flowrate as needed for a particular drilling operation without switching pumps, piston or liners.

The VFD can change the frequency of the electrical supply to the motor. By reducing the frequency, it decreases the motor's speed, and by increasing it, it raises the speed. This allows for precise control of the mud pump's output.

Using a VFD can result in significant energy savings. When the mud pump does not need to operate at full speed, the VFD can reduce the motor's speed, and hence power consumption, accordingly. This is especially useful in situations where the load on the pump varies, as it can adapt to the required output, reducing energy wastage and extending the motor's lifespan.

VFDs also provide the benefit of soft starting and stopping. Instead of abruptly starting the motor at full speed, which can cause mechanical stress and electrical spikes, a VFD gradually ramps up the speed. This reduces wear and tear on the equipment and provides a smoother operation. Similarly, when stopping the motor, it can ramp down gradually, preventing abrupt stops that could be damaging.

Many VFDs come with remote control options, allowing operators to adjust the speed and performance of the mud pump from a distance. This can be particularly useful for drilling operations where conditions may change rapidly.

A VFD for a mud pump is a valuable piece of equipment that allows for precise control of the mud pump's speed and power output, leading to improved energy efficiency, better performance, and reduced wear and tear on the equipment.

In various embodiments, the VFD and mud pumps can be automatically controlled to increase/decrease the flow rate and pressures by controlling the speed and/or power of the motors. FIG. 5 illustrates the steering control system 168 and the fluid circulation control system 526 and the mud pumps 536. In various embodiments, the steering control system 168 can include the variable frequency drive control and the mud pump control 526. In this way, as the mud pump pressure increases that can be controlled from the VFD drive control, the drilling system can increase or decrease the rate of drilling indirectly by controlling the rate of penetration of the drilling operation.

A spool system in a drilling operation, often referred to as a drilling spool or BOP (Blowout Preventer) spool, can be an important component that can be used to control and manage the flow of drilling fluids, wellbore pressure, and the wellhead during drilling, completion, and intervention activities in the oil and gas industry. The primary purpose of a spool system can be to ensure the safety and integrity of the well and to prevent blowouts or uncontrolled releases of hydrocarbons. A spool system can include a heavy-duty piece of equipment made of high-strength steel that is located at the wellhead, connecting various components of the drilling system. The primary function of a spool system is to provide a means to control the flow of drilling fluids and wellbore pressure. It also allows for the installation of blowout preventers (BOPs) and other well control equipment. A spool system typically has multiple connection points for various components. The components can include casing and tubing hangers that support and seal the casing or tubing strings that extend into the wellbore. The blowout preventer stack can be attached to the top of the spool. The BOP stack contains devices such as ram BOPs, annular BOPs, and a shear ram that can be activated in case of an emergency to seal the wellbore. The spool system can include choke and kill lines that can be high-pressure lines connected to the spool that allow for controlled release or injection of fluids into the wellbore. The choke and kill lines can be important for well control and pressure management. The spool system can include instrumentation ports for pressure and temperature sensors to monitor well conditions in real-time. In various embodiments, spools are equipped with various valves and controls to regulate the flow of drilling fluids, hydraulic fluids for the BOPs, and other operations. These valves can be manually or remotely operated.

Spool systems can be designed with safety features. The safety features can include pressure relief systems and other safety mechanisms to prevent overpressure situations and protect personnel on the rig.

Spools are typically made of high-strength steel to withstand the extreme pressures and temperatures encountered during drilling operations. They are also designed to meet industry standards and regulations for safety and reliability.

Regular inspection and maintenance of the spool system are crucial to ensure its functionality and safety. This includes checking for wear and tear, corrosion, and proper functioning of valves and controls.

In various embodiments, the spool system is configured to handle the increased pressures associated with a high-pressure piston-diaphragm pump.

In various embodiments, the mud pump 1100 may be in wired or wireless communication with one or more drilling systems or control systems, for example but not limited to control systems 510, 512, 514, 522, 524, and 526 (see FIG. 5). In some embodiments, the piston-diaphragm pumps used as mud pumps may include monitoring and control systems. These systems provide real-time data on pressure, flow rate, and other parameters, allowing operators to monitor and optimize pump performance and/or drilling performance, such as by increasing ROP. Advanced control features help maintain steady pressure and prevent overloading or damage to the pump. Transmitting data from the mud pump 1100 to one or more drilling or control systems may reduce costs associated with drilling the wellbore. For example, the data transmitted from the mud pump 1100 and/or downhole sensors may be transmitted to one or more drilling or control systems which may process the data and in turn may transmit instructions to the mud pump 1100 for altering the performance of the mud pump 1100 (e.g. flow rate or other characteristics of the mud pump unit's performance).

Figure 12A:
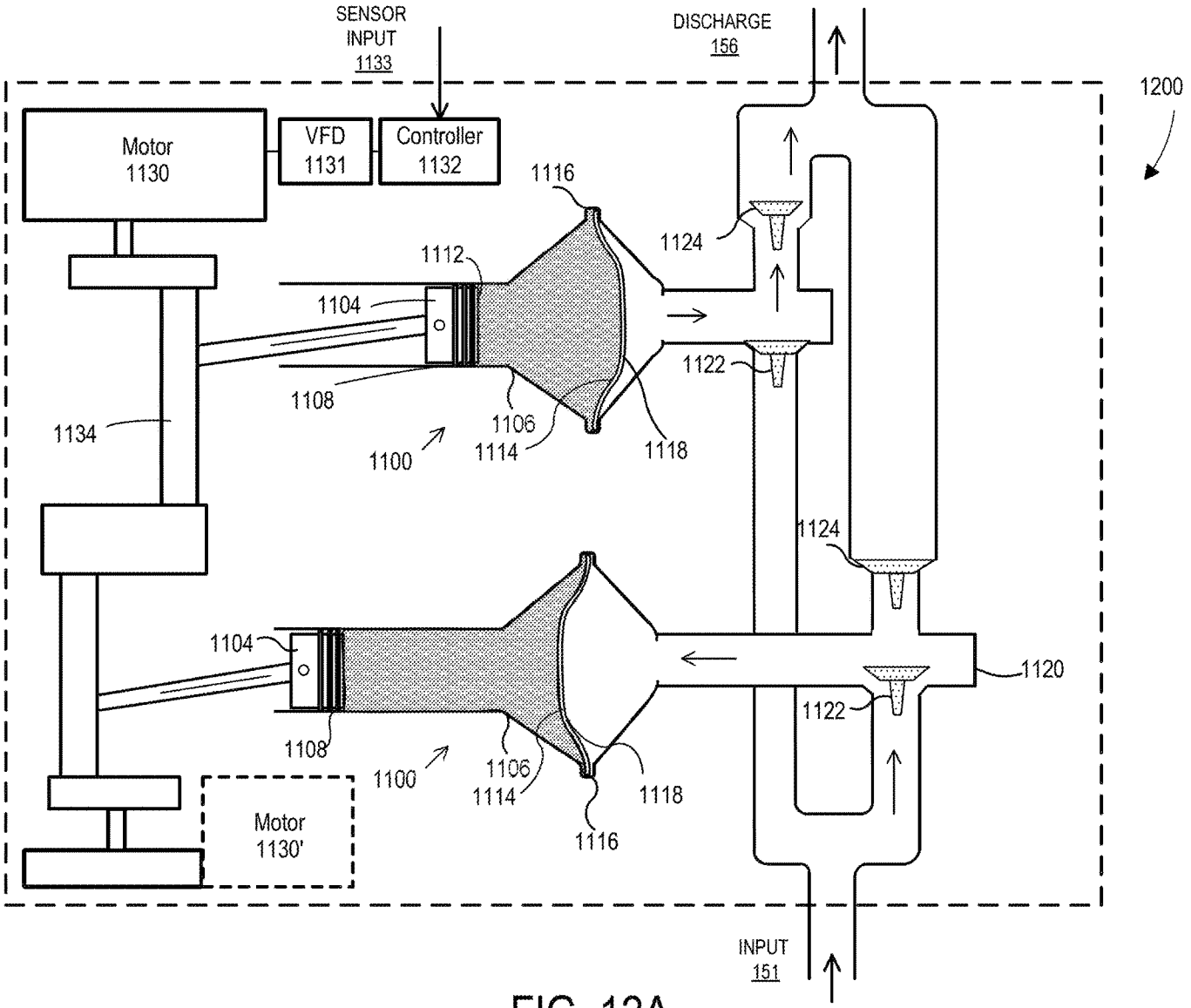
FIG. 12A illustrates an exemplary drilling mud pump unit utilizing two piston-diaphragm pumps and a single motor, in accordance with some embodiments.
Figure 12B:
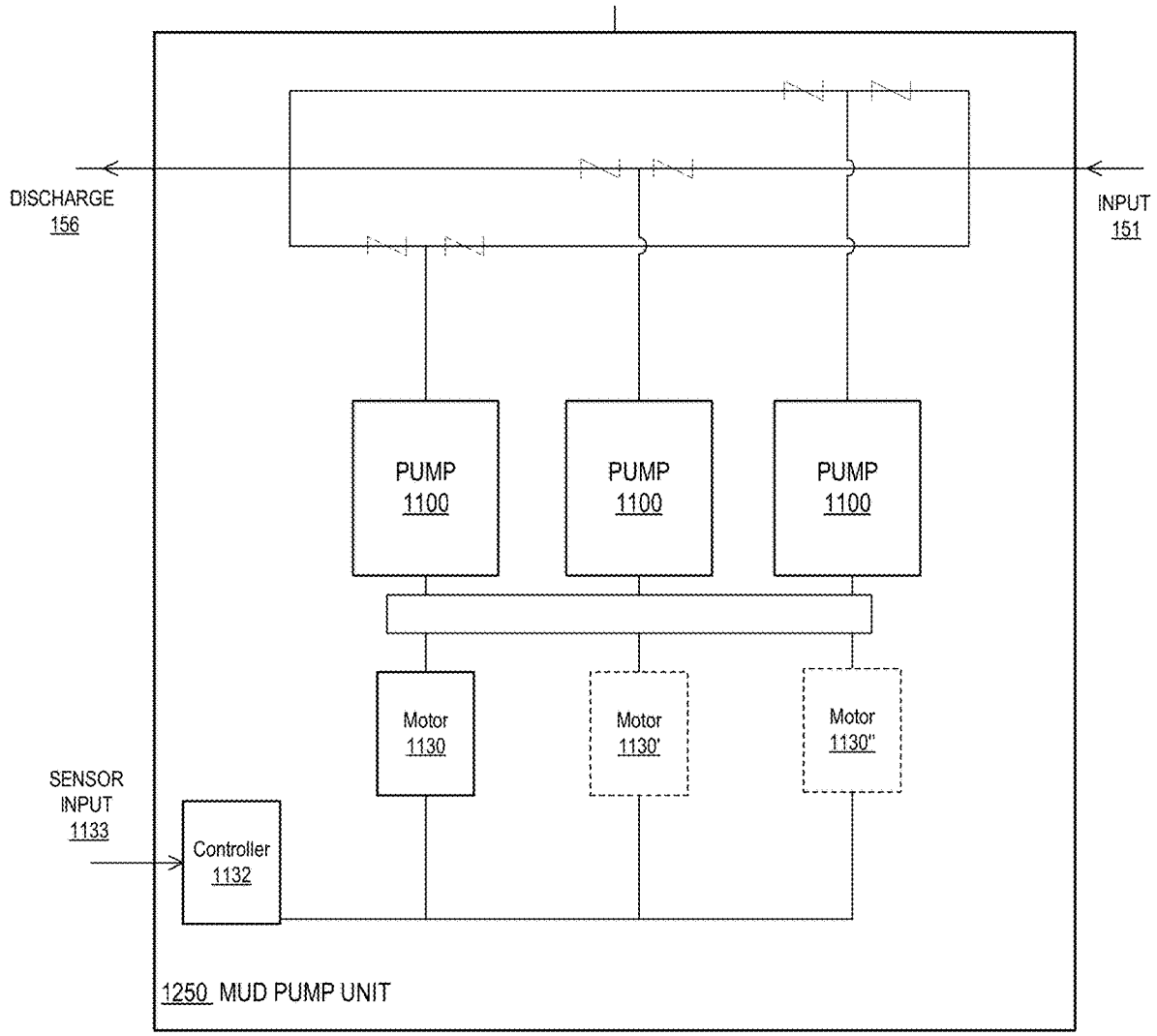
FIG. 12B illustrates an exemplary drilling mud pump unit utilizing three piston-diaphragm pumps, in accordance with some embodiments.

FIG. 12A is an exemplary drilling mud pump unit 1200, which can be used as the mud pump unit 152 in the drilling setup in FIG. 1. The mud pump unit 1200 includes two piston-diaphragm pumps 1100 that operate concurrently to pump a drilling fluid (e.g. drilling mud), which is fed to the pumps via input line 151 and discharged to the well via discharge line 156 at a desired pressure and/or flow rate. As shown each piston-diaphragm pump 1100 can be of exactly the same design, but configured within the mud pump such that one pump provides suction while the other pump provides discharge. Each mud pump 1100 can include the same components as previously described in FIG. 11. A controller 1132 operates the pump, including adjustment of the VFD 1131. In some embodiments, the controller 1132 controls pump operation to adjust flow rate and/or pressure based on sensor input 1133 from one or more downhole sensors. This can be performed automatically by one or more control systems of the overall drilling setup. As shown, the pistons 1104 of the two piston-diaphragm pumps are connected to a crank shaft 1134 that is driven by motor 1130. In this embodiment, the pumps are driven by a single motor, however, in other embodiments, the pumps could be driven by two motors (such as an additional motor 1130' shown in dashed, which can include an additional VFD). In various embodiments, a two-motor arrangement can power a 2,000-horsepower pump capable of 10,000 psi and 330 gpm. While two pumps are shown here, other embodiments could include additional pumps and could be driven by one or more motors, for example a three-pump mud pump unit, such as shown in FIG. 12B. The pistons are connected such that when the piston of one pump is retracted, the piston of the other pump is extended. When the piston of the pump is retracted (such as in the lower pump shown), pressure is reduced as the diaphragm is concave which draws drilling fluid into the second chamber, the lower check valve being open and the upper check valve being closed. When the piston of the pump is extended (such as in the top pump shown), pressure is increased and the diaphragm is convex, which discharges the drilling fluid from the second chamber, the lower check valve being closed and the upper check valve being open. The valves used can be a typical valve poppet and mating valve seat (e.g. API-7 style valve) or any suitable valve. By this design, the pump unit can provide a consistent high pressure and flow rate of the discharged drilling fluid by concurrent operation of the two pumps. As described previously, this pump unit design allows for high pressure (e.g. greater than 7,000 psi, 7,500 psi, 10,000 psi) and high flow rate (e.g. greater than 250 gpm, 300 gpm, 330 gpm) at the same time. By contrast, conventional mud pump units using conventional piston pumps typically provide either high pressure or high flow rate, but not both concurrently, and even then may require switching out pumps or pistons and liners to achieve a desired pressure or flow rate. The mud pump unit can further include or be coupled to a VFD 1131 driving the motor so as to vary the pressure and/or flow rate of the mud pump unit according to a desired operation without requiring switching out of piston and/or liners or pumps. The VFD can be controlled by one or more control systems associated with the drilling system setup.

FIG. 12B shows a mud pump unit 1250 utilizing three piston-diaphragm pumps 1100 in parallel. As in previous embodiments, the mud pump unit 1250 is fed drilling mud via input line 151 and discharges the drilling mud at the desired flow rate and/or pressure via discharge line 156. In this embodiment, the overall piping having check-valves to facilitate flow of drilling mud to each pump is similar in design and operation to that depicted in FIG. 12A. The piston-diaphragm pumps 1100 can be the same or similar in design and operation as that depicted in FIG. 12A and can include the same or similar components. The mud pump unit can include one or more motors 1130 for operating the three pumps, the one or more motors being adjustable by a VFD (not shown), as described previously. In some embodiments, the mud pump unit can include a single motor 1130. In other embodiments, the mud pump unit can include two motors 1130, 1130'. In still other embodiments, the mud pump unit can include three motors 1130, 1130', 1130".

Figure 12C:
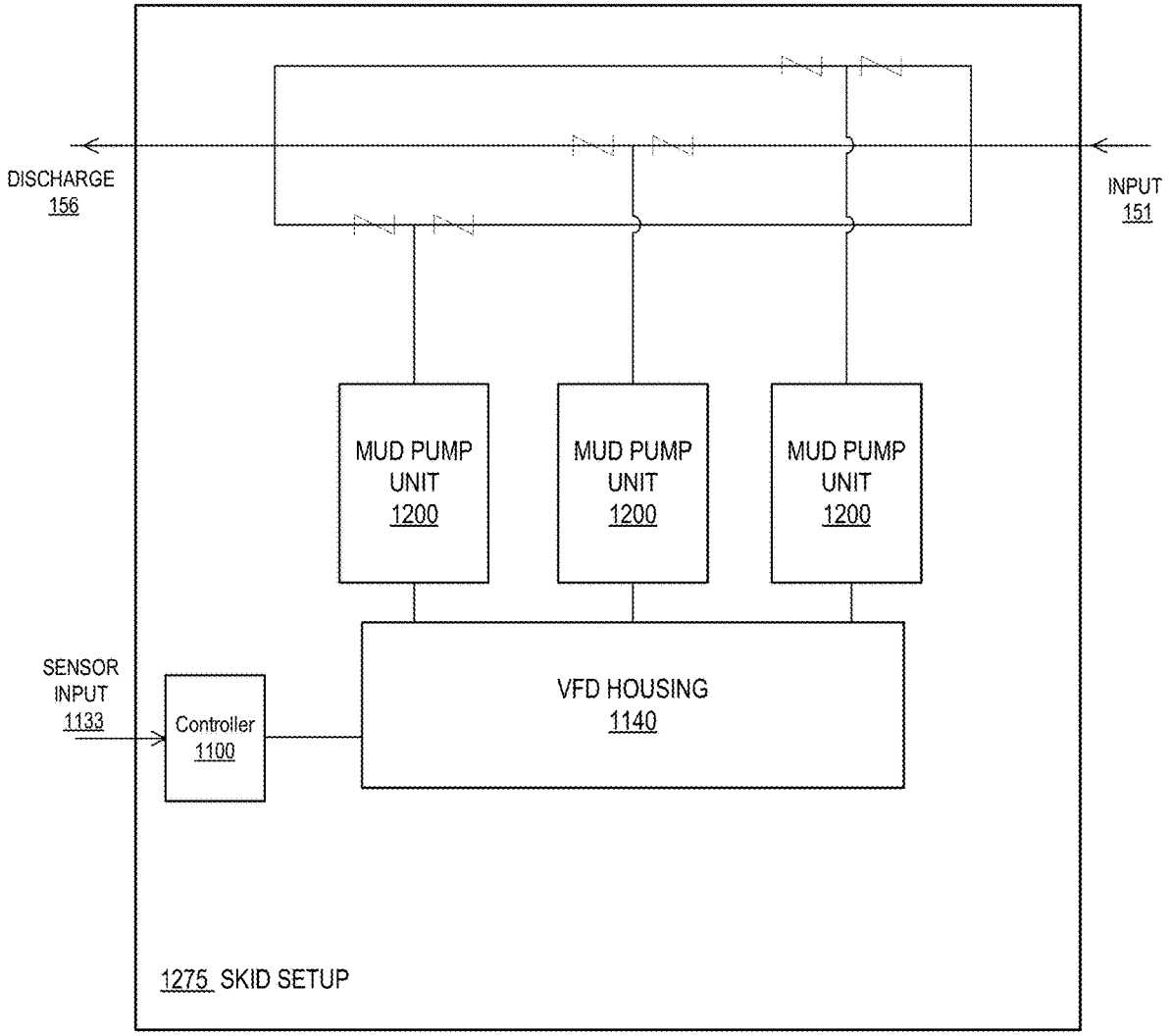
FIG. 12C illustrates a skit setup having three-mud pump units in parallel, in accordance with some embodiments.

In one implementation, multiple mud pump units can be provided on a skid setup and operated in parallel to greatly increase flow rate. For example, three mud pump units each providing 330 gpm can be operated on a skid setup to provide 990 gpm (flowrate being additive as the mud pumps operate in parallel). FIG. 12C shows such a skid setup 1275 having three mud pump units 1200 operating in parallel. Each mud pump unit 1200 can include two or more mud pumps 1100, such as the two-pump configuration in FIG. 12A or a three-pump configuration in FIG. 12B. Each mud pump unit can include one or more motors, such as a single motor configuration or a two-motor configuration, as described previously. In some implementations, three single motor mud pump units can be operated on a VFD housing 1140 that supports three motors. In various embodiments, a one-motor arrangement can power a 1,600-horsepower pump capable of 7,500 psi or more and 330 gpm. In other implementations, three double-motor mud pumps can be operated by a VFD housing 1140 that supports six total motors. In various embodiments, lower pressure (e.g., 7,500 psi) piston-diaphragm pumps may be used.

In some embodiments, the mud pump(s) and/or VFD(s) may be coupled to one or more drilling control systems. The control systems can receive data from downhole and/or surface sensors, and use that information for monitoring the flow rate and/or pressure of the drilling mud (including differential pressure), and adjusting the operation of one or more of the VFDs and/or mud pumps to maintain one or more desired setpoints for mud flow rate, mud pressure, and/or differential pressure. The control systems may be any of the computer systems described above, and may be programmed to monitor drilling parameters other than mud flow rates, pressure, and differential pressure. For example, the control systems may receive information regarding toolface orientation and may, in appropriate circumstances (such as when a measured toolface exceeds a threshold therefor or is outside a desired range therefor), send one or more control signals to the VFD and/or mud pump to increase or decrease flow rate, mud pressure, and/or differential pressure in order to maintain or adjust toolface.

In some embodiments, the control system may also be programmed to predict or detect anomalous drilling conditions or events. In such situations, it may be desirable to decrease or increase mud flow rate, pressure, and/or differential pressure, or to cease mud pumping altogether. For example, a stall detection and/or recovery system may be coupled to one or more VFDs and/or one or more mud pumps. The stall detection and/or recovery system can detect and/or recover from a mud motor stall automatically, and in doing so may be programmed to decrease or cease mud pumping operations and then begin mud pumping as part of the stall recovery. In such situations, the stall recovery system may send one or more control signals to the VFDs and/or the mud pumps to begin pumping and increase flow rate, pressure, and/or differential pressure in a predetermined manner, such as by gradually increasing such variables over a given time period from zero mud flow or pressure to a set flow rate, pressure, or differential pressure. An example of such a stall detection and recovery system is described in U.S. Pat. No. 11,466,556 B2, issued on Oct. 11, 2022, titled "Stall Detection and Recovery for Mud Motors", which is hereby incorporated by reference in its entirety.

In some embodiments, the control system may be programmed to respond automatically to one or more determinations based on an analysis of the drilling mud and its contents. For example, if the control system detects a kick (e.g., an influx of fluids into the wellbore), it may be desirable to increase the mud flow rate, pressure, and/or differential pressure. The control system may also be programmed to correctly time the addition of various chemicals or materials to the drilling mud based on drilling conditions. An example of such a control system is described in U.S. Pat. No. 11,613,983, issued on Mar. 28, 2023, titled "System and Method for Analysis and Control of Drilling Mud and Additives," which is hereby incorporated by reference in its entirety. A control system also may be coupled to one or more of the VFDs and/or mud pumps to implement adjustments to the mud flow rate, pressure, and/or differential pressure in response to borehole cleaning conditions. For example, such a system may be useful in determining if and when a drill bit will get stuck due to a lack of desired borehole cleaning. An example of such a system is described in U.S. Pat. No. 12,055,028 B2, issued on Aug. 6, 2024, titled "System and Method for Well Drilling Control Based on Borehole Cleaning", which is hereby incorporated by reference in its entirety.

In still other embodiments, it may be useful during drilling to automatically transition from a slide drilling operation to a rotary drilling operation, and vice versa. In such transitions, mud pumping may need to be decreased, ceased altogether, and increased and the transition unfolds. In some embodiments, the pressure may be increased when during sliding of the drill bit and decreased during vertical drilling. A control system may be coupled to the drilling rig and its related equipment to control such transitions, and may be coupled to the one or more VFDs and/or mud pumps to control the flow rate, pressure, and/or differential pressure as the transition is made from sliding to rotary drilling or vice versa. A control system useful for such transitions is described in U.S. Pat. No. 10,830,033 B2, issued on Nov. 10, 2020, titled "Apparatus and Methods for Uninterrupted Drilling," which is hereby incorporated by reference.

Figure 13:
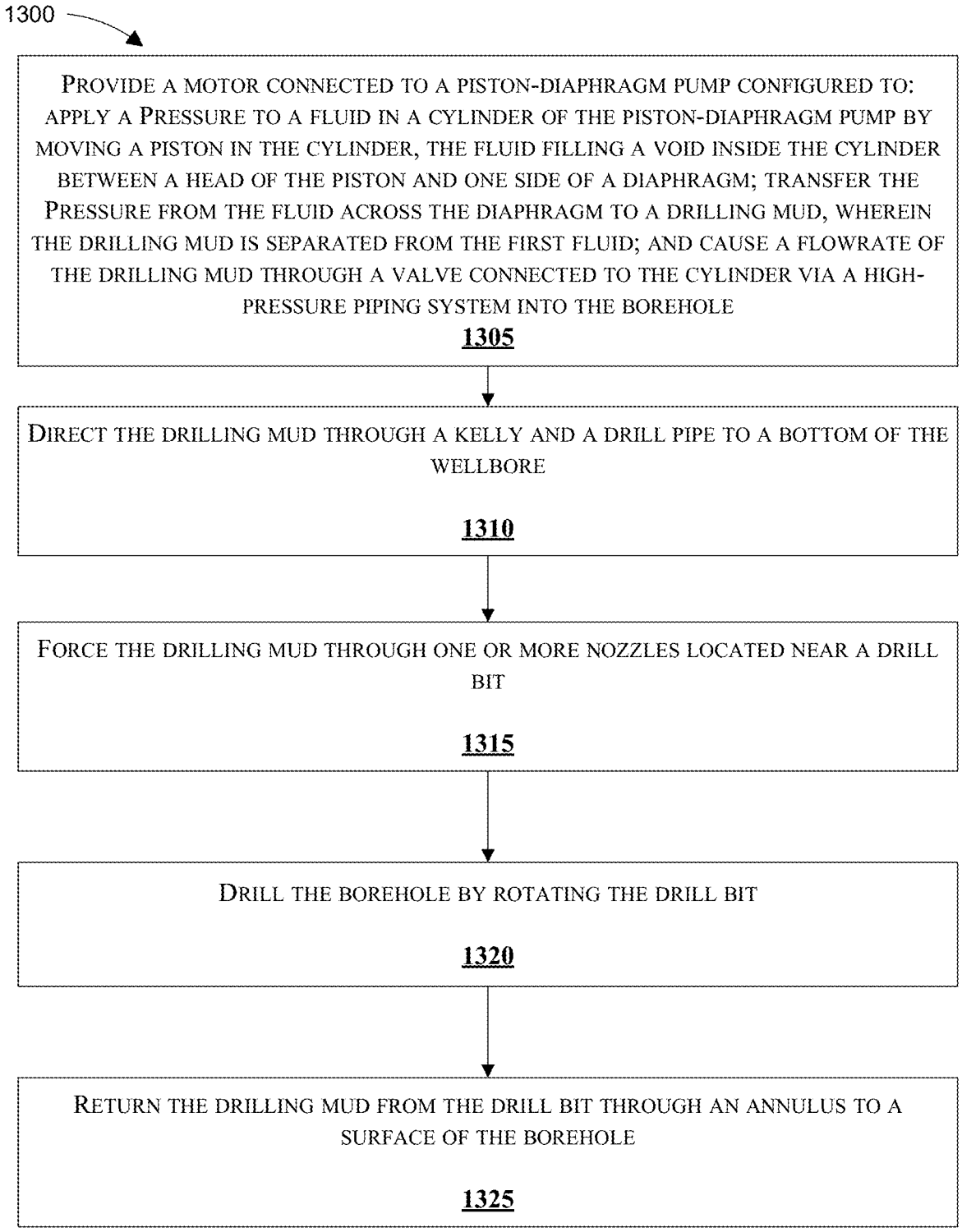
FIG. 13 illustrates an exemplary flowchart for drilling a borehole using a piston diaphragm pump.

FIG. 13 is a flow chart of a process 1300 for drilling a borehole, according to an example of the present disclosure. According to an example, one or more process blocks of FIG. 13 may be performed by a drilling rig.

At block 1305, process 1300 may include providing a motor connected to a piston-diaphragm pump configured to: apply a pressure to a fluid in a cylinder of the piston-diaphragm pump by moving a piston in the cylinder, the fluid filling a void inside the cylinder between a head of the piston and one side of a diaphragm; transfer the pressure from the fluid across the diaphragm to a drilling mud, where the drilling mud is separated from the first fluid; and cause a flowrate of the drilling mud through a valve connected to the cylinder via a high-pressure piping system into the borehole. At block 1310, process 1300 may include directing the drilling mud through a kelly and a drill pipe to a bottom of the wellbore. At block 1315, process 1300 may include forcing the drilling mud through one or more nozzles located near a drill bit. At block 1320, process 1300 may include drilling the borehole by rotating the drill bit. For example, a drilling rig may drill the borehole by rotating the drill bit, as described above. At block 1325, process 1300 may include returning the drilling mud from the drill bit through an annulus to a surface of the borehole. It should be noted that while FIG. 13 shows example blocks of process 1300, in some implementations, process 1300 may include additional blocks, fewer blocks, different blocks, or differently arranged blocks than those depicted in FIG. 13. Additionally, or alternatively, two or more of the blocks of process 1300 may be performed in parallel.

Figure 14:
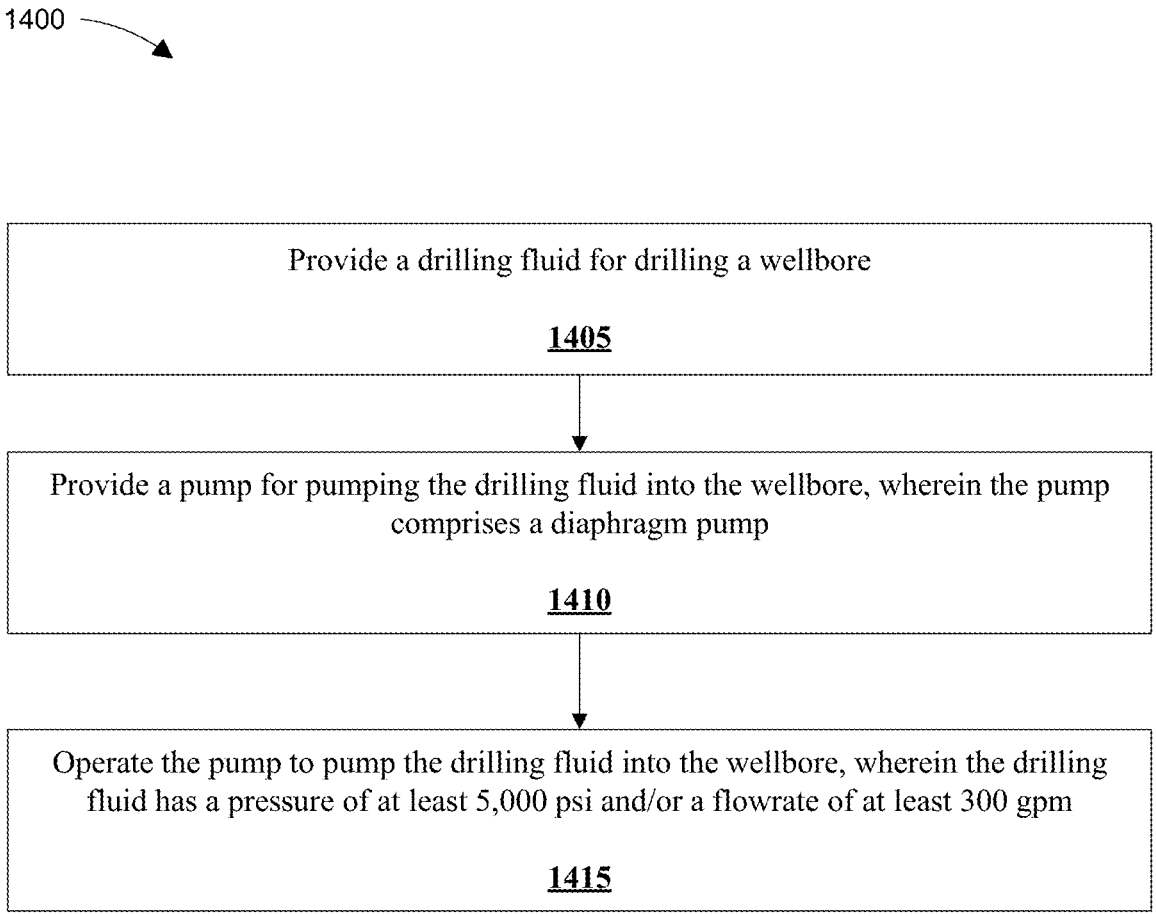
FIG. 14 illustrates an exemplary flowchart for providing drilling mud to a wellbore for drilling using a piston diaphragm pump.

FIG. 14 is a flow chart of a process 1400, according to an example of the present disclosure. According to an example, one or more process blocks of FIG. 14 may be performed by mud pump system.

At block 1405, process 1400 may include providing a drilling fluid for drilling a wellbore. For example, mud pump system may provide a drilling fluid for drilling a wellbore, as described above.

At block 1410, process 1400 may include providing a pump for pumping the drilling fluid into the wellbore, where the pump may include a diaphragm pump. For example, mud pump system may provide a pump for pumping the drilling fluid into the wellbore, where the pump may include a diaphragm pump, as described above.

At block 1415, process 1400 may include operating the pump to pump the drilling fluid into the wellbore at a pressure of at least 5,000 psi and/or at a flowrate of at least 250 gpm. For example, mud pump system may operate the pump to pump the drilling fluid into the wellbore, where the drilling fluid has a pressure of at least 5,000 psi, as described above. In some embodiments, the pump generates pressure greater than 7,000 psi (e.g. 7,500 psi, 10,000 psi). In some embodiments, the pump generates pressure greater than 300 gpm (e.g. 330 gpm).

It should be noted that while FIG. 14 shows example blocks of process 1300, in some implementations, process 1400 may include additional blocks, fewer blocks, different blocks, or differently arranged blocks than those depicted in FIG. 14. Additionally, or alternatively, two or more of the blocks of process 1400 may be performed in parallel.

Figure 15:
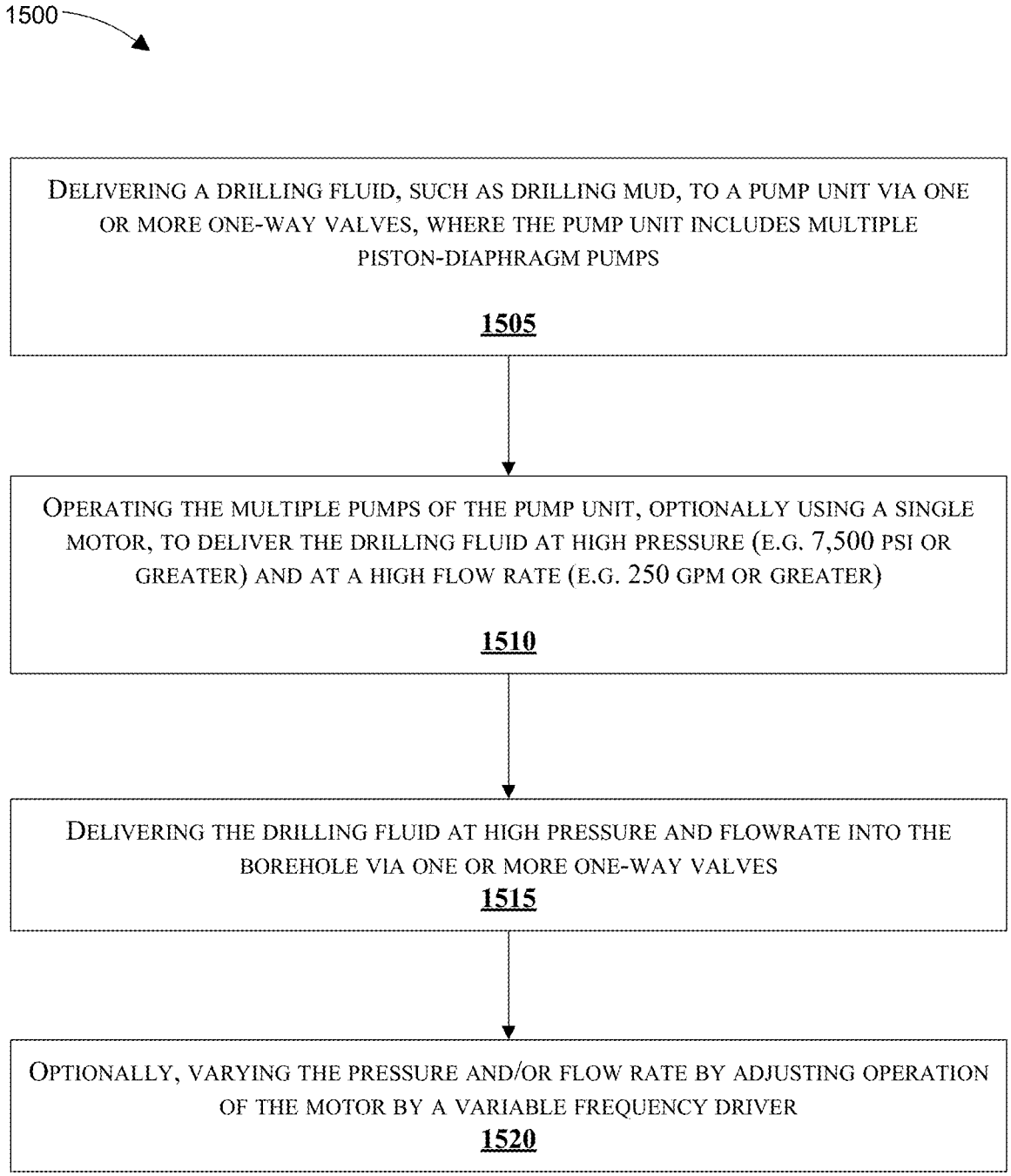
FIG. 15 illustrates an exemplary flowchart for delivering drilling mud at high pressure and flowrates for drilling by use of a pump unit having piston diaphragm pumps.

FIG. 15 is a flow chart of a process 1500, according to an example of the present disclosure. According to an example, one or more process blocks of FIG. 15 may be performed by mud pump system, such as that shown in FIGS. 1 and 12.

At block 1505, a drilling fluid is delivered to the pump unit via one or more one-way valves (e.g. check valves), where the pump unit includes multiple piston-diaphragm pumps. The drilling fluid may be fed to the pump unit through an input line by operation of a centrifugal pump or any suitable means. The drilling fluid, which can be drilling mud, is isolated from a first fluid, such as oil, disposed within a chamber in which the piston of the pumps operate, as described previously. At block 1510, the multiple pumps are operated, optionally by use of a single motor, to deliver the drilling fluid at a high pressure, such as 7,000 psi or greater, and at a high flow rate, such as 250 gpm or greater. At block 1515, the drilling fluid is delivered into the borehole via one or more one-way valves at the desired pressure and/or flow rate. Optionally, at block 1520, the motor can be varied to achieve a desired pressure and/or flow rate by adjustment of a VFD driving the motor. For example, a higher flow rate may be desired during an initial phase of drilling down vertically, and a higher pressure may be desired when drilling laterally during a secondary phase of drilling the borehole. Advantageously, the mud pump operation can be varied to achieve both high flow rate and high pressure as desired for a given drilling operation without changing pumps, piston and liners. In some embodiments, since use of a piston-diaphragm pump in the pump unit avoids contact of the drilling fluid with the piston and cylinder of the pumps, the pump unit service life is extended considerably, for example, such a pump unit may have a service life of greater than a year, 3 years, 5 years, 10 years or more.

In various embodiments, the pump comprises a motor which is operable at least 1,500 horsepower. In some embodiments, the pump unit can use a 1,600 HP motor. In some embodiments, the pump unit uses a 2,000 HP motor.

In various embodiments, the pump unit is configured to generate a flow rate in the wellbore of at least 200 gpm.

In various embodiments, the drilling fluid has a pressure of at least 7,000 psi and a flow rate of at least 250 gpm.

In various embodiments, the drilling fluid has a pressure of between 7,000 psi and 8,000 psi and a flow rate of between 250 and 350 gpm.

In various embodiments, wherein the drilling fluid has a pressure of 7,500 psi and a flow rate of 330 gpm.

In various embodiments, the drilling fluid has a pressure of between 9,500 psi and 10,500 psi and a flow rate of between 250 and 350 gpm.

In various embodiments, method further includes providing two diaphragm pumps for pumping the drilling fluid into the wellbore.

In various embodiments, the method further includes operating a pump unit having no more than two diaphragm pumps for pumping the drilling fluid into the wellbore.

In various embodiments, the method further includes providing a variable frequency drive coupled to at least one of the pumps.

In various embodiments, the method further includes reducing the time required for maintenance for the diaphragm pump(s) than the time that would otherwise be required for maintenance of one or more piston pumps for pumping the drilling fluid. In some embodiments, the pump unit is configured such that the pistons and liners are not replaced during the service life of the pump unit.

It is to be noted that the foregoing description is not intended to limit the scope of the claims. For example, it is noted that the disclosed methods and systems include additional features and can use additional drilling parameters and relationships beyond the examples provided. The examples and illustrations provided in the present disclosure are for explanatory purposes and should not be considered as limiting the scope of the invention, which is defined only by the following claims.

What is claimed is:

1. A method of drilling a borehole, the method comprising:

moving a piston in a cylinder of a piston-diaphragm pump to apply a pressure to a first fluid in the cylinder of the piston-diaphragm pump, the first fluid filling a void inside the cylinder between a head of the piston and a first side of a diaphragm;

transferring the pressure from the first fluid across the diaphragm to a drilling mud, wherein the drilling mud is separated from the first fluid by the diaphragm;

responsive to moving the piston in the cylinder of the piston-diaphragm pump, closing a low-pressure check valve in fluid communication with the cylinder and opening a high-pressure check valve connected to the cylinder;

operating the pump to generate a flowrate of the drilling mud through the high-pressure check valve via a high-pressure piping system into the borehole at a pressure of at least 5,000 psi and at a flowrate of at least 200 gallons per minute (gpm); and directing the drilling mud through a drill pipe and into the borehole.

2. The method of claim 1, further comprising:

forcing the drilling mud through one or more nozzles located near a drill bit;

drilling the borehole by rotating the drill bit; and returning the drilling mud from the drill bit through an annulus to a surface of the borehole.

3. The method of claim 1, wherein the diaphragm flexes to a concave shape at a bottom of a stroke of the piston and the diaphragm flexes to a convex shape at the top of the stroke of the piston.

4. The method of claim 1, wherein the first fluid is a lubricating oil.

5. The method of claim 1, wherein the diaphragm is of a material suitable to withstand contact with drilling mud for a service lifetime of the pump.

6. The method of claim 1, wherein the pump is operated by a motor of 1,600 horsepower or greater.

7. A method of drilling a wellbore, the method comprising:

providing a drilling fluid for drilling a wellbore;

providing a pump unit including a piston-diaphragm pump having a piston in a cylinder for pumping the drilling fluid into the wellbore;

operating the pump unit to deliver the drilling fluid into the wellbore at a first pressure of at least 5,000 psi and at a flowrate of at least 200 gallons per minute (gpm);

moving the piston in the cylinder of a piston-diaphragm pump to apply a pressure to a first fluid in the cylinder of the piston-diaphragm pump, the first fluid filling a void inside the cylinder between a head of the piston and a first side of a diaphragm;

transferring the pressure from the first fluid across the diaphragm to a drilling mud in a void on a second side of the diaphragm opposite the first side, wherein the drilling mud is separated from the first fluid by the diaphragm; and responsive to moving the piston in the cylinder of the piston-diaphragm pump to apply the pressure to the first fluid, closing a low-pressure check valve in fluid communication with the cylinder and opening a high-pressure check valve connected to the cylinder, wherein the drilling mud flows from the void on the second side of the diaphragm through the high-pressure check valve into the wellbore.

8. The method of claim 7, wherein the drilling fluid is delivered at a pressure of at least 7,000 psi and a flow rate of at least 250 gpm.

9. The method of claim 7, wherein drilling fluid is delivered at a pressure of at least 7,500 psi and a flow rate of at least 300 gpm.

10. The method of claim 7, wherein the pressure is delivered at a pressure of between 9,500 psi and 10,500 psi and a flow rate between 250 and 350 gpm.

11. The method of claim 7, wherein the pump unit comprises two piston-diaphragm pumps for pumping the drilling fluid into the wellbore, wherein one piston-diaphragm pump provides suction at the same time the other piston-diaphragm pump provides discharge.

12. The method of claim 11, further comprising adjusting at least one of the pressure and flow rate by adjusting a variable frequency drive driving one or more motors operating the plurality of piston-diaphragm pumps.

13. The method of claim 1, wherein the drilling mud has a pressure of at least 7,000 psi and a flow rate of at least 250 gallons per minute (gpm).

14. The method of claim 1, wherein the drilling mud has a pressure of between 7,000 psi and 8,000 psi and a flow rate of between 250 and 350 gpm.

15. The method of claim 1, wherein the method further includes providing a second piston-diaphragm pumps for pumping the drilling mud into the borehole.

16. The method of claim 15, further comprising:

moving a second piston in a second cylinder of the second piston-diaphragm pump to apply a pressure to a second fluid in the second cylinder of the second piston-diaphragm pump, the second fluid filling a void inside the second cylinder between a head of the second piston and a first side of a second diaphragm.

17. The method of claim 16, wherein the first and second pistons are connected such that when the first piston is retracted the second piston is extended, such that when one piston-diaphragm pump provides suction at the same time the other piston-diaphragm pump provides discharge.

18. The method of claim 1 further comprising providing a second and a third piston-diaphragm pump, each of the three pumps operating in parallel, for pumping the drilling mud into the bore at a pressure of at least 5,000 psi and at a flowrate of at least 990 gallons per minute (gpm).

19. The method of claim 1 further comprising adjusting at least one of the pressure and flow rate by adjusting a variable frequency drive driving one or more motors operating the plurality of piston-diaphragm pumps.

20. The method of claim 1, wherein drilling fluid is delivered at a pressure of at least 7,500 psi and a flow rate of at least 300 gpm.

21. The method of claim 1, wherein the pressure is delivered at a pressure of between 9,500 psi and 10,500 psi and a flow rate between 250 and 350 gpm.

22. The method of claim 7, wherein the diaphragm flexes to a concave shape at a bottom of a stroke of the piston and the diaphragm flexes to a convex shape at the top of the stroke of the piston.

23. The method of claim 7, wherein the method further includes providing a second piston-diaphragm pumps for pumping the drilling mud into the borehole.

24. The method of claim 1, wherein the pump unit comprises two piston-diaphragm pumps for pumping the drilling fluid into the wellbore, wherein one piston-diaphragm pump provides suction at the same time the other piston-diaphragm pump provides discharge.

25. The method of claim 24, further comprising adjusting at least one of the pressure and flow rate of the drilling mud by adjusting a variable frequency drive driving one or more motors operating of the plurality of piston-diaphragm pumps.

26. The method of claim 7, wherein the drilling mud has a pressure of between 7,000 psi and 8,000 psi and a flow rate of between 250 and 350 gpm.

27. The method of claim 26, further comprising:

moving a second piston in a second cylinder of the second piston-diaphragm pump to apply a pressure to a second fluid in the second cylinder of the second piston-diaphragm pump, the second fluid filling a void inside the second cylinder between a head of the second piston and a first side of a second diaphragm.

28. The method of claim 27, wherein the first and second pistons are connected such that when the first piston is retracted the second piston is extended, such that when one piston-diaphragm pump provides suction at the same time the other piston-diaphragm pump provides discharge.

29. A method of drilling a borehole, the method comprising:

moving a first piston in a first cylinder of a first piston-diaphragm pump to apply a pressure to a fluid in the first cylinder of the first piston-diaphragm pump, the fluid filling a void inside the first cylinder between a head of the first piston and a first side of a first diaphragm;

transferring the pressure from the fluid across the first diaphragm to a drilling mud, wherein the drilling mud is separated from the fluid by the first diaphragm;

responsive to moving the first piston in the first cylinder of the first piston-diaphragm pump, closing a first low-pressure check valve in fluid communication with the first cylinder operating the pump to generate a flowrate of the drilling mud through the first high-pressure check valve in a high-pressure piping system into the borehole at a pressure of at least 5,000 psi and at a flowrate of at least 200 gallons per minute (gpm);

moving a second piston in a second cylinder of a second piston-diaphragm pump to apply a pressure to a fluid in the second cylinder of the second piston-diaphragm pump, the fluid filling a void inside the second cylinder between a head of the second piston and a first side of a second diaphragm;

transferring the pressure from the fluid across the second diaphragm to a drilling mud, wherein the drilling mud is separated from the fluid by the second diaphragm;

responsive to moving the second piston in the second cylinder of the second piston-diaphragm pump, closing a second low-pressure check valve in fluid communication with the second cylinder operating the pump to generate a flowrate of the drilling mud through the second high-pressure check valve via a high-pressure piping system into the borehole at a pressure of at least 5,000 psi and at a flowrate of at least 200 gallons per minute (gpm); and directing the drilling mud through a drill pipe and into the borehole.

30. The method of claim 29, wherein the first and second pistons are connected such that when the first piston is retracted the second piston is extended, such that when one piston-diaphragm pump provides suction at the same time the other piston-diaphragm pump provides discharge.

31. The method of claim 1, wherein the pressure is delivered at a pressure of between 9,500 psi and 10,500 psi and a flow rate between 250 and 350 gpm.

32. The method of claim 7, wherein the diaphragm flexes to a concave shape at a bottom of a stroke of the piston and the diaphragm flexes to a convex shape at the top of the stroke of the piston.

33. The method of claim 7, wherein the drilling mud has a pressure of between 7,000 psi and 8,000 psi and a flow rate of between 250 and 350 gpm.

* * * * *